US008360620B1

(12) United States Patent
Rashidi

(10) Patent No.: US 8,360,620 B1
(45) Date of Patent: Jan. 29, 2013

(54) LED DIRECT AND INDIRECT RECESSED LIGHTING FIXTURE WITH CENTER DIFFUSER LENS BASKET AND PARALLEL REFLECTORS, INCLUDING RAPID ACCESS DOORS TO THE FIXTURE DRIVERS AND EMERGENCY BATTERY PACK

(76) Inventor: Hamid Rashidi, Beverly Hills, CA (US)

( * ) Notice: Subject to any disclaimer, the term of this patent is extended or adjusted under 35 U.S.C. 154(b) by 404 days.

(21) Appl. No.: 12/803,225

(22) Filed: Jun. 21, 2010

(51) Int. Cl.
*F21V 15/00* (2006.01)

(52) U.S. Cl. ..... 362/364; 362/373; 362/217.01; 362/217.1

(58) Field of Classification Search ..... 362/364, 362/373, 217.01–217.17
See application file for complete search history.

(56) References Cited

U.S. PATENT DOCUMENTS 5,692,821 A * 12/1997 Rodriguez et al. ..... 353/52
7,854,534 B2 * 12/2010 Liu ..... 362/294
7,926,982 B2 * 4/2011 Liu ..... 362/294
8,047,680 B2 * 11/2011 Huang et al. ..... 362/249.02
2003/0081419 A1 * 5/2003 Jacob et al. ..... 362/364
2009/0141494 A1 * 6/2009 Zhang et al. ..... 362/249.03

* cited by examiner

*Primary Examiner* — Diane I Lee
*Assistant Examiner* — Sean Gramling
(74) *Attorney, Agent, or Firm* — Thomas I. Rozsa

(57) ABSTRACT

An LED recessed lighting fixture which includes a multiplicity of LED boards which have a multiplicity of LEDs thereon, the LED boards affixed to a heat sink to dissipate the heat generated from the LEDs. The LED boards are shrouded by a diffuser so that light from the LEDs shining through the diffuser mimics a fluorescent light. The fixture incorporates at least one reflector into the fixture so that some of the illumination from the LEDs will be reflected off the reflector after it has passed through the diffuser. An access door in the top of the fixture so that access to a driver retained within the fixtures can be provided from the top of the fixture. An access door in the top of the fixture so that access to an emergency battery retained within the fixture can be provided from the top of the fixture.

48 Claims, 28 Drawing Sheets

LED DIRECT AND INDIRECT RECESSED LIGHTING FIXTURE WITH CENTER DIFFUSER LENS BASKET AND PARALLEL REFLECTORS, INCLUDING RAPID ACCESS DOORS TO THE FIXTURE DRIVERS AND EMERGENCY BATTERY PACK

BACKGROUND OF THE INVENTION

1. Field of the Invention

The present invention relates to the field of recessed lighting systems which utilize light emitting diodes ("LEDs").

2. Description of the Prior Art

In general, the concept of utilizing LEDs in recessed lighting fixtures has been known. However, to the best of the present inventor's knowledge, the use of LEDs which will mimic a fluorescent light has not been developed in the prior art. There is a significant need for such an innovation.

SUMMARY OF THE INVENTION

The present invention is an LED recessed lighting fixture which includes a multiplicity of LED boards which have a multiplicity of LEDs thereon, the LED boards affixed to a heat sink to dissipate the heat generated from the LEDs. The LED boards are shrouded by a center diffuser lens basket so that light from the LEDs shining through the diffuser mimics a fluorescent light.

It is an object of the present invention to provide an LED recessed lighting fixture which has the illumination from the LEDs shining through a diffuser which can be made of frosted acrylic material or perforated metal so that the illumination appears to come from a fluorescent light.

It is a further object of the present invention to incorporate at least one reflector into the fixture so that some of the illumination from the LEDs will be reflected off the reflector after it has passed through the diffuser.

It is an additional object of the present invention to provide an access door in the top of the fixture so that access to a driver retained within the fixtures can be provided from the top of the fixture.

It is also an object of the present invention to provide an access door in the top of the fixture so that access to an emergency battery retained within the fixture can be provided from the top of the fixture.

It is a further object of the present invention to have the diffuser and at least one reflector removably retained within the fixture so that access to the emergency battery and driver can also be achieved from the bottom of the fixture.

It is additional object of the present invention to stagger LEDs on different boards so that the light will diffuse more evenly.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated:

FIG. 12A is an enlarged detailed view of a front lower end;

FIG. 12B is an enlarged detailed view of a rear lower end;

FIG. 12C is an enlarged detailed view of the interconnection of a reflector with the heat sink;

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

The present invention is an LED direct and indirect recessed lighting fixture which includes a center diffuser lens basket and reflectors. The fixture can be in various sizes including a first embodiment which has a generally square shape with a given length and width which by way of example can be 2 feet by 2 fee and a second embodiment which has a generally rectangular shape length and width which by way of example can be 2 feet by 4 feet.

The present invention LED direct and indirect recessed lighting fixture is designed to mimic a fluorescent light but in fact has an LED fixture which is shrouded in a frosted acrylic or perforated metal diffuser to defuse the light emitted from the LEDs.

Figure 3:
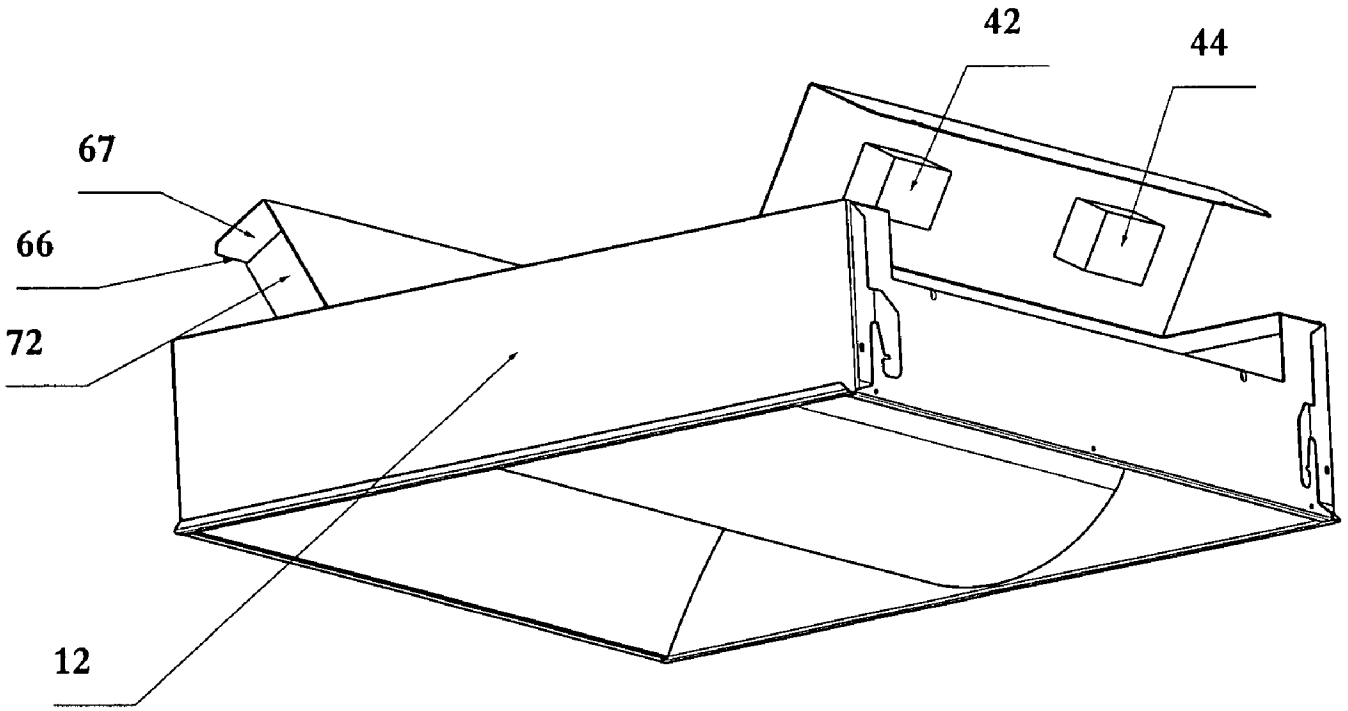
FIG. 3 is a bottom perspective view of a first embodiment of the present invention LED direct and indirect recessed lighting fixture which is generally square in shape, with the emergency access doors in the opened position.
Figure 4:
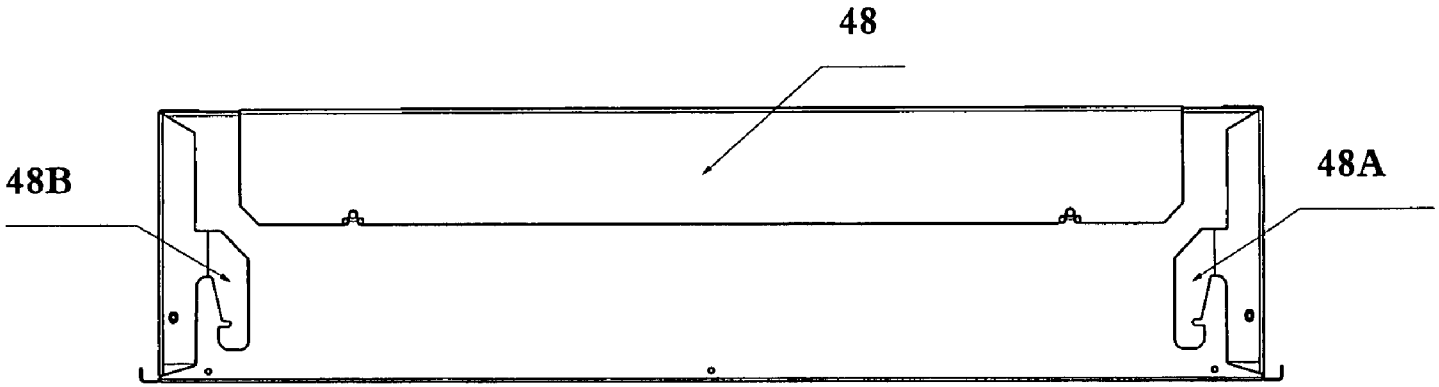
FIG. 4 is a rear elevational view of a first embodiment of the present invention LED direct and indirect recessed lighting fixture; which is generally square in shape, with the emergency access doors in the opened position.
Figure 5:
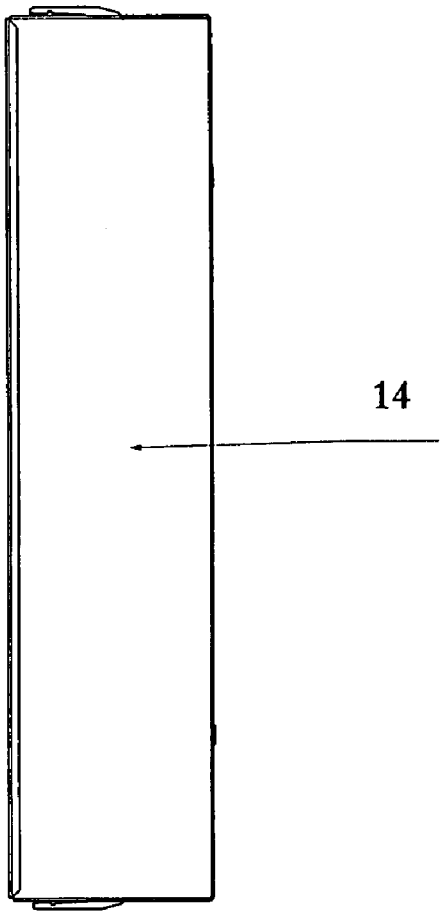
FIG. 5 is a right side front elevational view of a first embodiment of the present invention LED direct and indirect recessed lighting fixture; which is generally square in shape, with the emergency access doors in the opened position.
Figure 6:
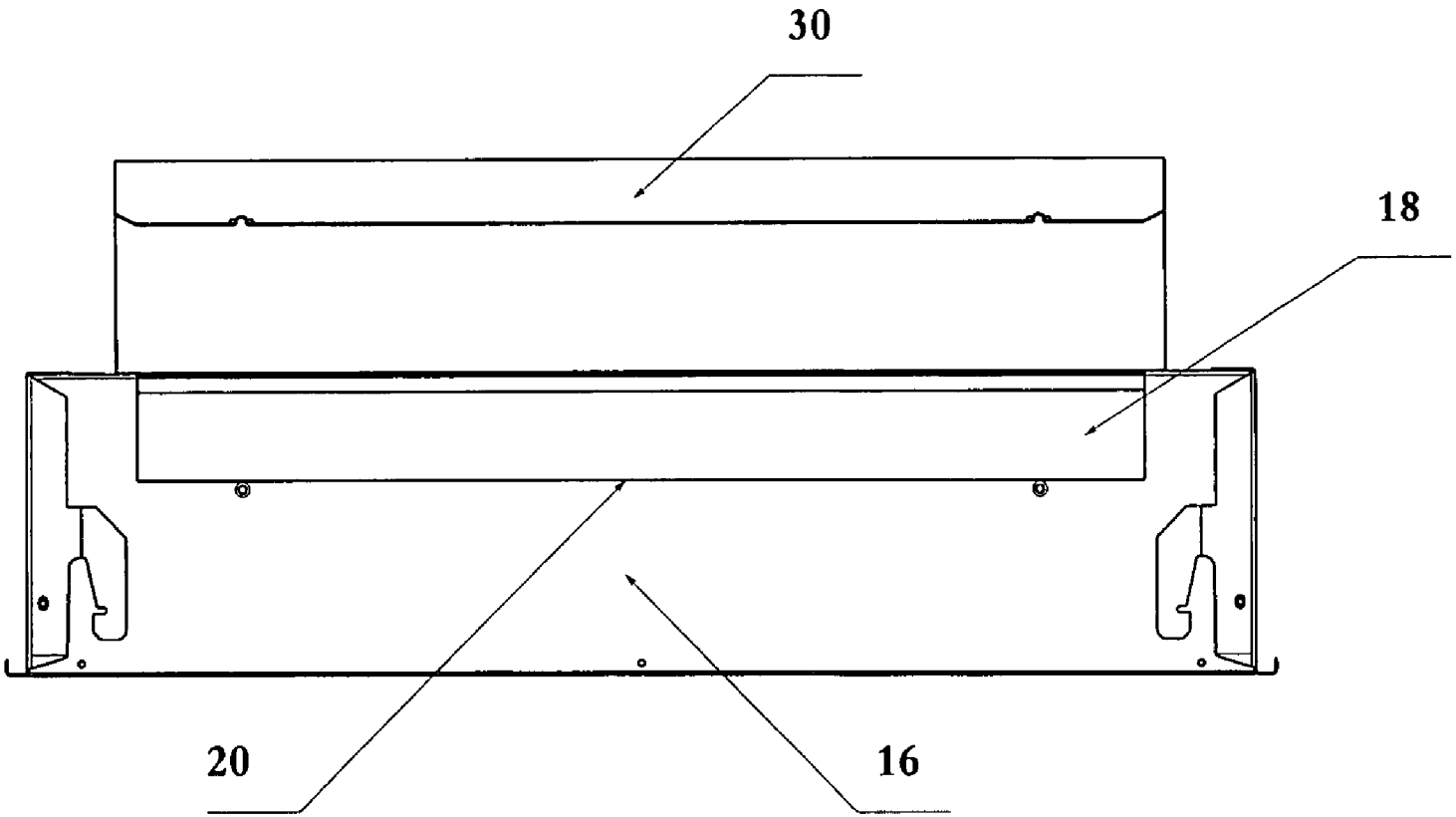
FIG. 6 is a front elevational view of a first embodiment of the present invention LED direct and indirect recessed lighting fixture; which is generally square in shape, with the emergency access doors in the opened position.

Referring to FIGS. 1-13, there is illustrated the first embodiment of the present invention which is generally square shape in length and width and can be approximately 2 feet. long by 2 feet. wide. The LED direct and indirect recessed lighting fixture 10 has a first lengthwise sidewall 12, a second parallel oppositely disposed lengthwise sidewall 14, a first transverse wall 16 and a second transverse wall 48 and a top wall 80 which form a generally square shaped object. First transverse wall 16 has a top opening 18 and interior edge 20. Referring to FIG. 12A, first transverse wall 16 has a lower end wall 22 with an interiorly extending transverse lip 24. Top wall 80 has a first opening 82 which joins opening 18 in first transverse wall 16. One of the unique innovations of the present invention is a first access door 30 having a top section 32 with an interior edge 34, the top section extending to a transverse section 35 having a lower edge 36 into which are formed a pair of spaced apart fastening members or teeth 38 and 40. The interior edge 34 of top section 32 of access door 30 is affixed to a hinge 34A where top access door 30 rotatably opens about hinge 34A. The lower edge 36 of transverse section 35 is removably affixed to interior edge 20 of first transverse wall 16 by teeth 38 and 40. Referring to FIG. 3, the fixture 10 contains a pair of spaced apart drivers 42 and 44 which are affixed to the interior surface 31 of access door 30. By incorporating first rapid access door 30, access to both drivers 42 and 44 can be rapidly achieved from above the fixture 10 without having to dismantle the fixture from below.

Parallel oppositely disposed second transverse wall 48 has a top opening 50 and interior edge 52. Referring to FIG. 12B, second transverse wall 48 has a lower end wall 54 with an interiorly extending transverse lip 56. Top wall 80 has a second opening 84 with joins opening 50 in second transverse wall 48. A second unique innovation of the present invention is a second access door 60 having a top section 62 with an interior edge 64. The interior edge 64 of top section 62 of access door 60 is affixed to a hinge 65 where top access door 60 rotatably opens about hinge 65. The lower edge 66 of transverse section 67 is removably affixed to interior edge 52 of second transverse wall 48 by teeth 68 and 70. Referring to FIG. 3, the fixture 10 contains an emergency battery back 72 which is affixed to the interior surface 65 of access door 60. By incorporating second rapid access door 60, access to the emergency battery 72 can be rapidly achieved from above the fixture 10 without having to dismantle the fixture from below.

The key innovation of the present invention is that it is an LED recessed light which is designed to mimic a fluorescent light. Referring to FIGS. 7 through 12, the invention contains a multiplicity of LED boards. By way of example only, the present invention includes five LED boards which include a center horizontal LED board 100, a first side bottom LED board 110, a second side bottom LED board 120 with LED boards 110 and 120 being parallel to each other and located adjacent opposite sides of center LED board 100, a first angled LED board 130 which is adjacent LED board 110 but extends at an angle to the horizontal LED boards extending from the bottom toward the interior of the fixture and a second angled LED board 140 which is adjacent LED board 120 and extends at an angle to the horizontal LED boards with boards 130 and 140 extending at opposite angles to each other.

Figures 7, 7A, 7B:
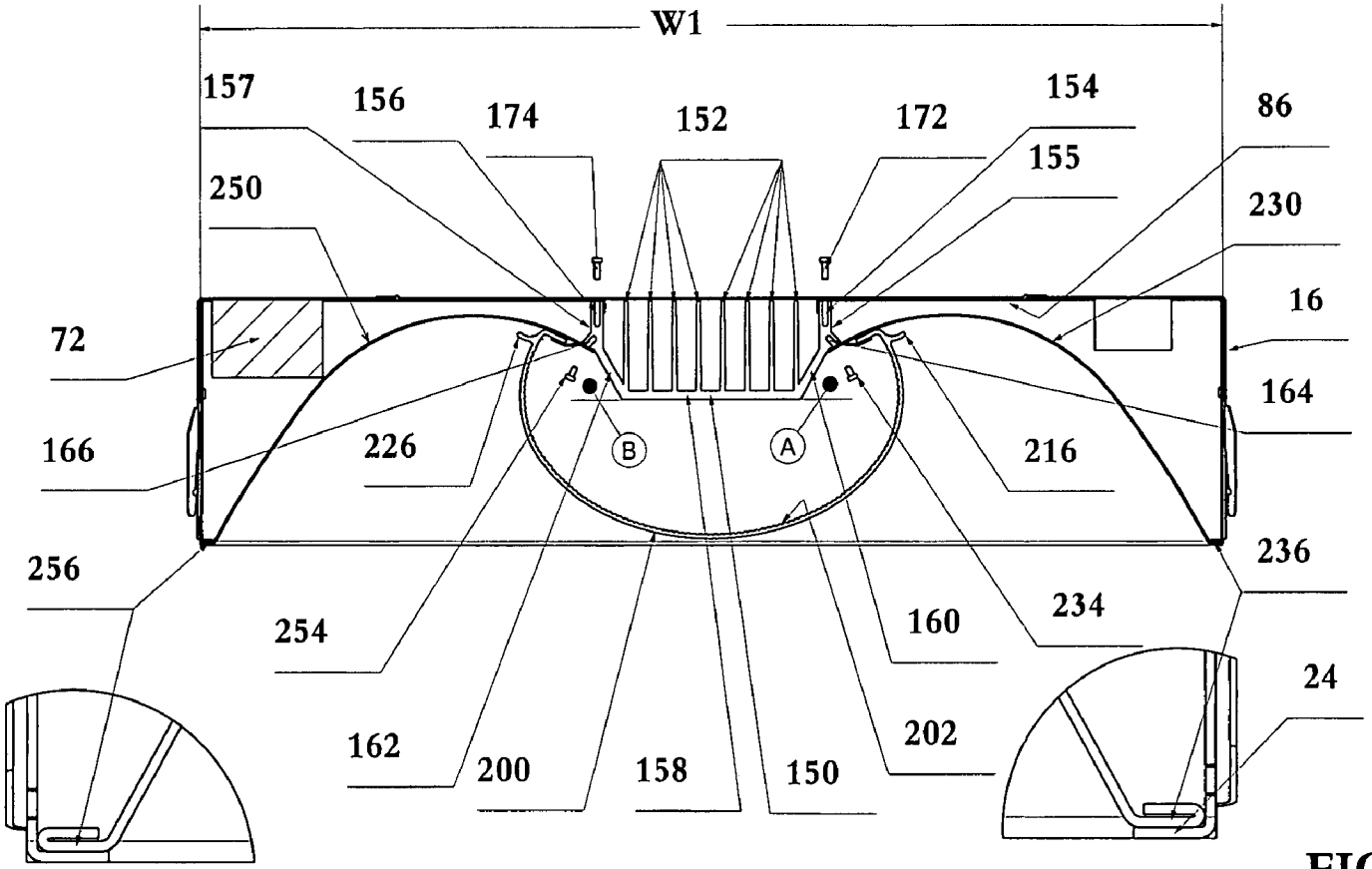
FIG. 7 is a cross-sectional view taken along line 10-10 of FIG. 10
FIG. 7A is an enlarged detailed view of a front lower end.
FIG. 7B is an enlarged detailed view of a rear lower end

As illustrated in FIG. 7, by way of example, first angled LED board 130 can extend at an angle "A" which is approximately 60 degrees to the horizontal and second angled LED board 140 also extends at an oppositely disposed angle "B" which also is approximately 60° to the horizontal. It will appreciated that angle "A" and angle "B" can range from 0° to 80°. The first center horizontal LED board 100 has a lower surface 102 with a multiplicity of LEDs 104 thereon, and an upper surface 106. The first side bottom LED board 110 has a lower surface 112 multiplicity of LEDs 114 thereon, and an upper surface 116. The second side bottom LED board 120 has a lower surface 122 with a multiplicity of LEDs 124 thereon, and an upper surface 126. The first angled LED board 130 has a lower surface 132 with a multiplicity of LEDs 134 thereon, and an upper surface 136. The first angled LED board 140 has a lower surface 142 with a multiplicity of LEDs 144 thereon, and an upper surface 146.

Figure 1:
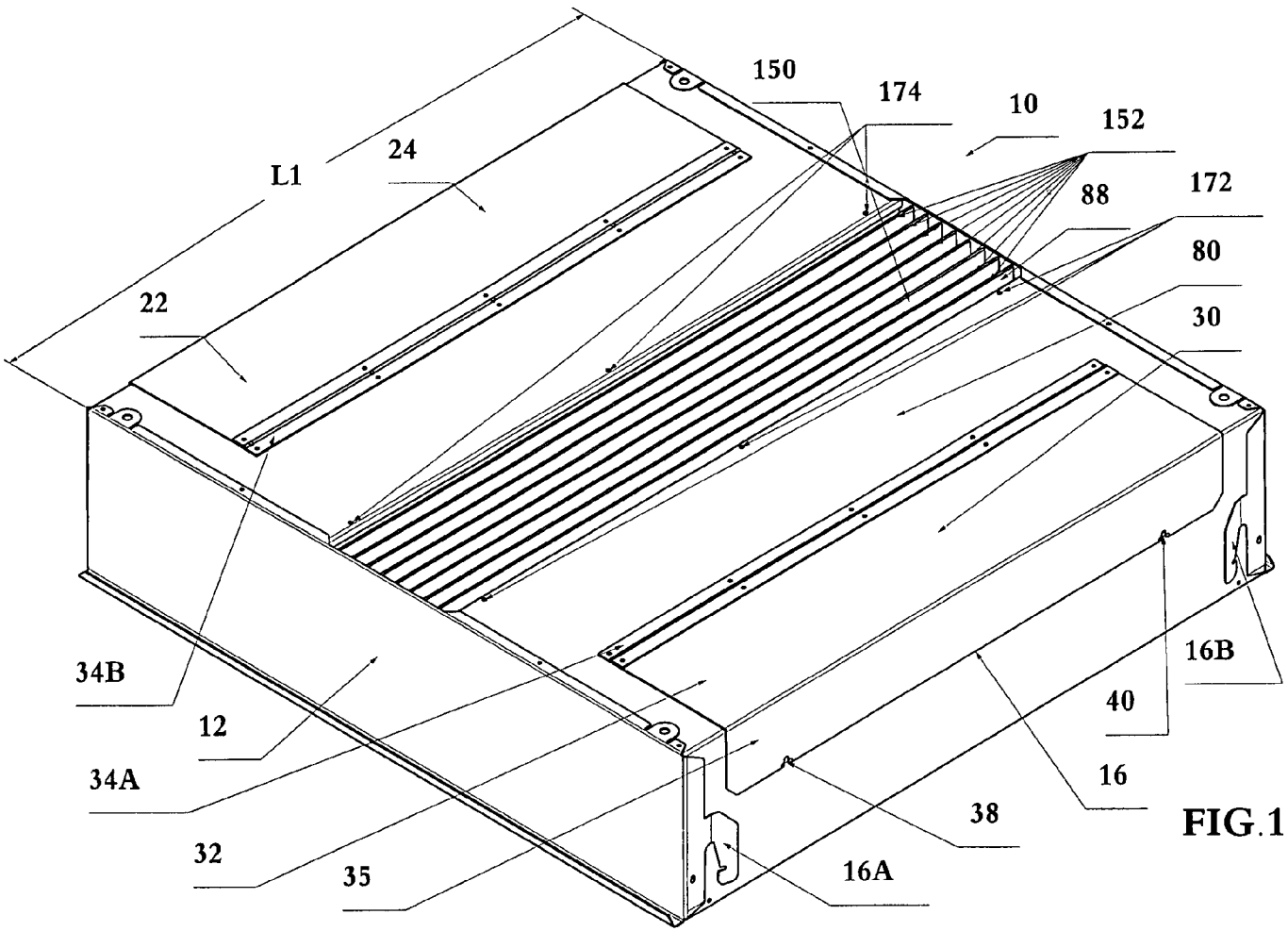
FIG. 1 is a top perspective view of a first embodiment of the present invention LED direct and indirect recessed lighting fixture which is generally square in shape, with the emergency access doors in the closed position.
Figure 2:
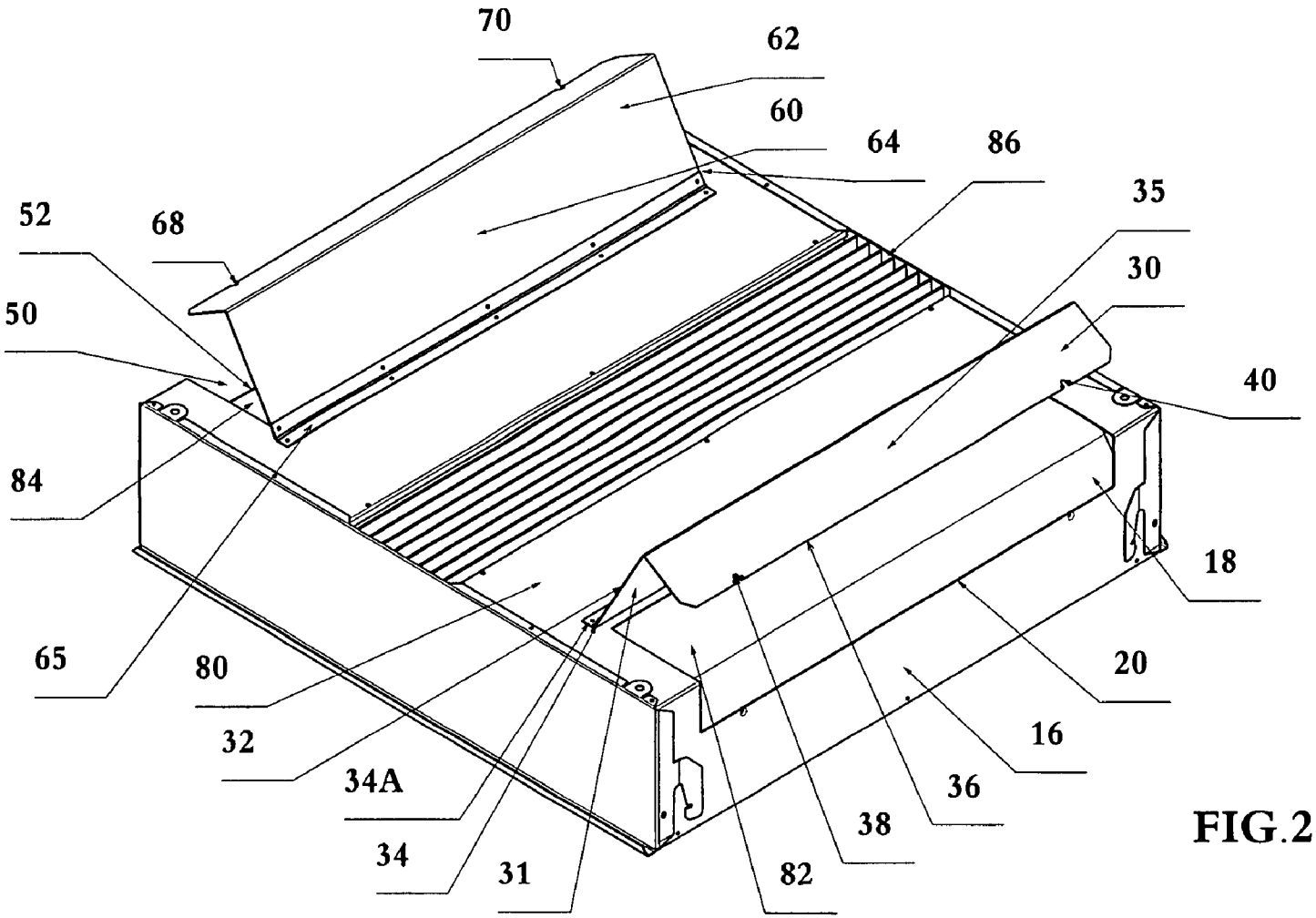
FIG. 2 is a top perspective view of a first embodiment of the present invention LED direct and indirect recessed lighting fixture which is generally square in shape, with the emergency access doors in the opened position.

The LED boards are affixed to a heat sink 150 having a multiplicity of fins 152 thereon which serve to dissipate heat from the LEDs. As illustrated in FIG. 1, the multiplicity of fins 152 of the heat sink 150 extend out of a center opening 88 in top wall 80 so that the heat can be dissipated into the area above the recessed lighting fixture 10. The heat sink has a first upper vertical interior channel 154 and a spaced apart second vertical channel 156 as illustrated in FIG. 7. The heat sink is affixed to the top wall 80 by respective fastening screws 172, 174, extending through corresponding openings in top wall 80 and threaded into respective locations in interior channels 154 and 156 so that the exterior top ends of heat sink 150 rest just below lower surface 86 of top wall 80 while the multiplicity of fins 52 extend out of top opening 88 in top wall 80. Interior channel 154 is formed into first width-wise side 155 of heat sink 150. Interior channel 15 is formed into second width-wise side 157 of heat sink 150. There can be at least two sets of screws 172 and 174 and preferably as illustrated in FIG. 1, three sets of spaced apart screws 172 and 174 evenly spaced along the width of the fixture, with one in the approximate center and two adjacent respective sidewalls.

The heat sink has a bottom wall 158 to which respective top surfaces 102, 112 and 122 of the three horizontally oriented LED boards 100, 110 and 120 are affixed. The heat sink has a first angled bottom wall 160 to which the top surface 132 of first angled LED board 130 is affixed. The heat sink has an oppositely disposed second angled bottom wall 162 to which the top surface 142 of second angled LED board 140 is affixed. All three bottom walls 158, 160 and 162 are connected to at least one of the multiplicity of fins 152 of the heat sink 150. The heat sink also includes a first angled lower interior channel 164 within first width-wise side 155 of heat sink 150, and an oppositely disposed second angled lower interior channel 166 within second width-wise side 157 of heat sink 150. The angled lower channels are preferably at an angle of 45 degrees to the horizontal.

Referring to FIG. 1, the fixture 10 has a given interior length "L1". In a preferred embodiment, the heat sink 150 extends for the entire interior length of the fixture 10. Referring to FIG. 7, the fixture 10 has a given interior width "W1". In a preferred embodiment, the heat sink 150 is positioned in the middle of the fixture. In a preferred embodiment, the heat sink 10 is retained entirely within the fixture 10.

It will be appreciated that while five LED boards 100, 110, 120, 130 and 140 are illustrated, it is within the spirit and scope of the present invention to have at least one LED board, and preferably at least three LED boards with one being a horizontally disposed board and the other two LED boards being disposed at an angle to the horizontally disposed board and extending at opposite angles to each other as illustrated in the cross-sectional view of FIG. 7. Regardless of the configuration, the LED boards are all affixed to the heat sink 150 with fins 152 so that the heat from the LEDs can be dissipated out of the fixture 10 and into the area above where the fixture is located in the ceiling of a structure.

One of the unique innovations of the present invention is that the LED boards 100, 110, 120, 130 and 140 are shrouded in a frosted acrylic or perforated metal diffuser lens 200 which is in the shape of a longitudinal basket extending the entire interior width of the fixture 10 and which serves to diffuse the light from the LEDs. The light from the LEDs is transmitted through the diffuser lens 200. An additional improvement is the incorporation of a wavy interior surface 202 on the interior of the diffuser lens 200. The wavy interior surface causes the lights from the LEDs to bounce off the wavy surface and provide a smooth warm illumination glow. The wavy surface also serves to hide the spot locations where illumination from the LEDs are emitted.

Figure 11A:
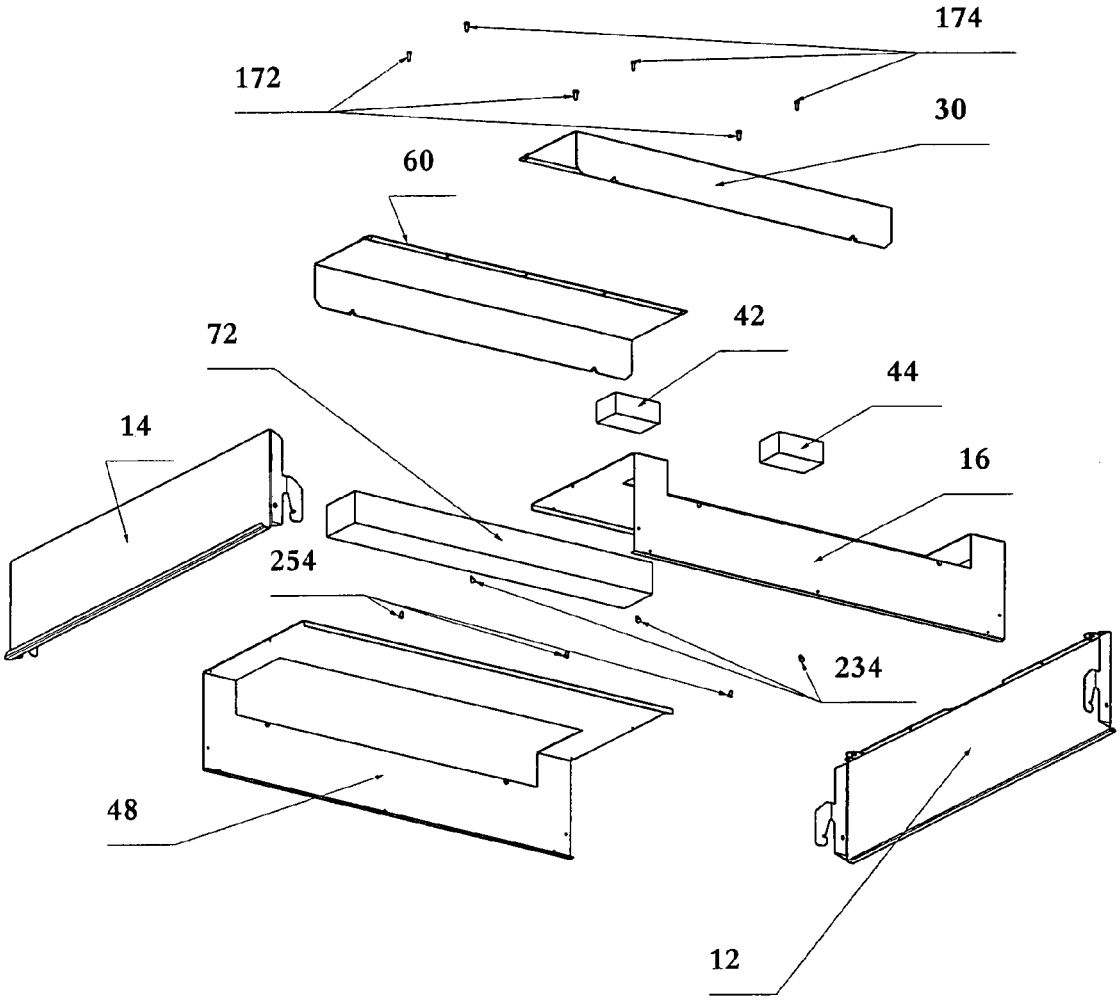
FIGS. 11A and 11B is an exploded view illustration the opponents of the present invention LED direct and indirect recessed lighting fixture.
Figure 11B:
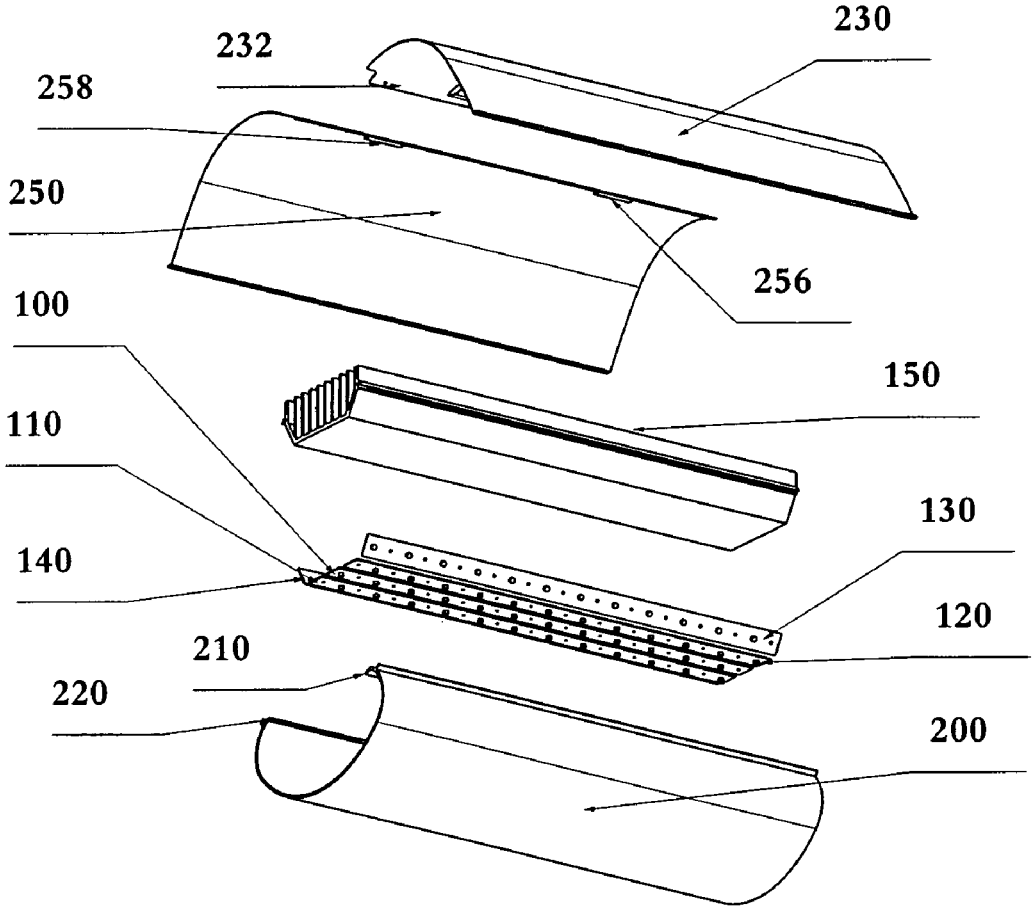
Figure 12:
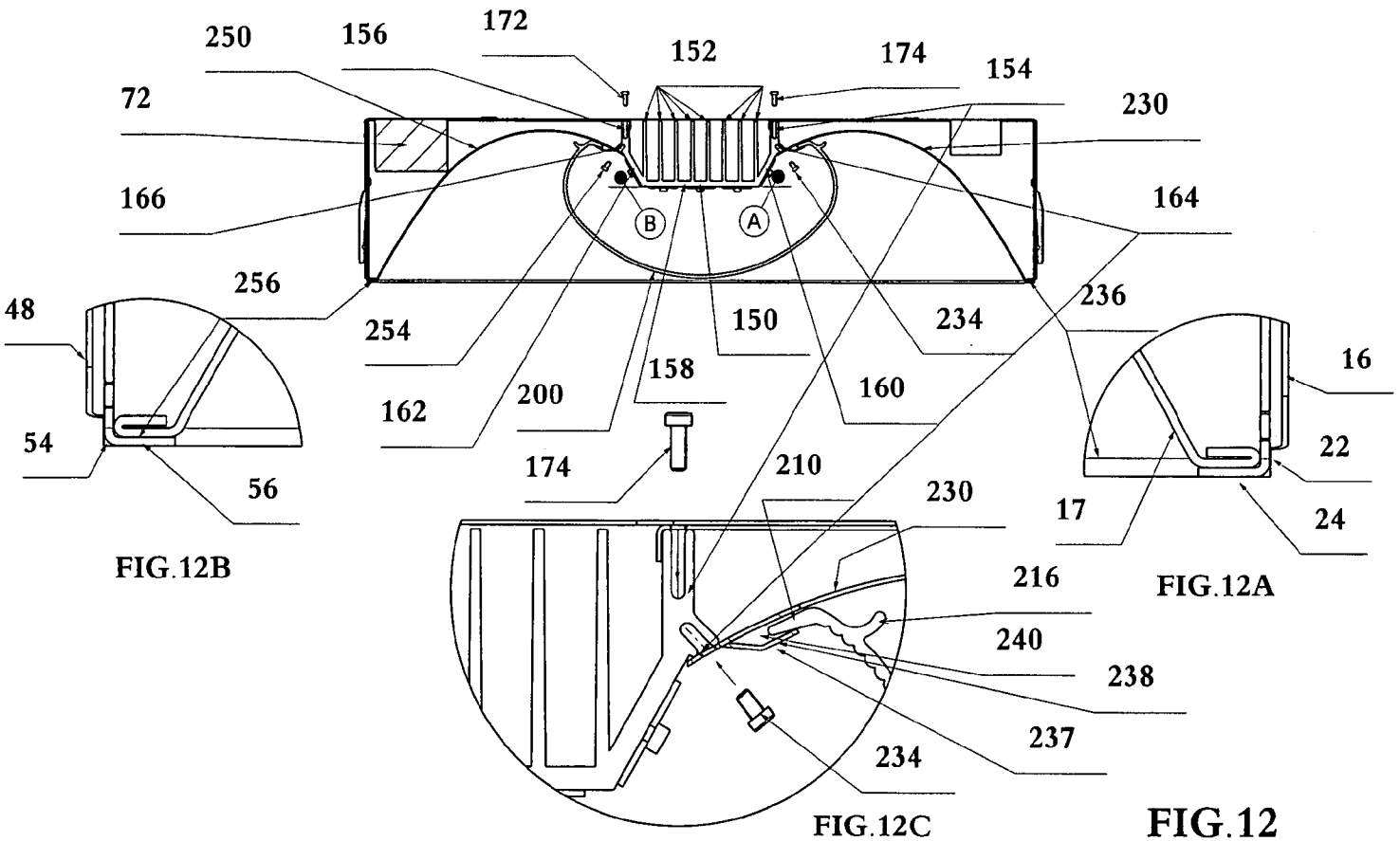
FIG. 12 is a cross-sectional view taken along line 10-10 of FIG. 10

As best illustrated in FIG. 11, the diffuser lens 200 is arc shaped having a first width-wise edge 210 and a gripping finger 216 (see FIG. 7) spaced apart from width-wise edge 210 and extending at an upward angle from diffuser lens 200. The diffuser lens 200 also has a parallel oppositely disposed second width-wise edge 220 and a gripping finger 226 (see FIG. 7) spaced apart from width-wise edge 220 and extending at an upward angle from diffuser lens 200.

Another innovation of the present invention is the incorporation of a first arcuate reflector 230 which extends from a location adjacent one width-wise side 155 of the heat sink 150 in an arcuate shape until it terminates at a location adjacent first transverse wall 16. The arcuate reflector 230 has an interior width-wise proximal edge 232 and is removably affixed to the heat sink by a multiplicity of spaced apart respective fastening screws 234 respectively screwed into first angled lower interior channel 164. At its distal end, the arcuate reflector 230 terminates in an upturned end 236 which rests on transverse lip 24 on the lower section 22 of first transverse wall 26, as best illustrated in FIG. 12A. The first arcuate reflector has a pair of spaced apart retaining tongues of which one 237 is illustrated in detail in FIG. 12C with a first spaced apart interior retaining wall 238 with a channel 240 between the interior retaining wall 238 and reflector wall 230. The first arcuate reflector has an identical tongue assembly at spaced apart location. The first width-wise edge 210 of diffuser 200 is removably received within and retained in channel 240 and pressed between retaining wall 238 of each tongue 237. Gripping finger 226 rests just below first arcuate reflector 230.

It is within the spirit and scope of the present invention for the fixture 10 to include a second arcuate reflector 250 which extends from a location adjacent a second width-wise side 157 of the heat sink 150 in an arcuate shape until it terminates at a location adjacent second transverse wall 48. The arcuate reflector 250 has an interior width-wise proximal edge 252 and is removably affixed to the heat sink by a multiplicity of respective fastening screws 254 respectively screwed into second angled lower interior channel 166 of heat sink 150. At its distal end, the arcuate reflector 250 terminates in an upturned end 256 which rests on transverse lip 56 adjacent lower wall portion 54 of second transverse wall 48. The second arcuate reflector has a pair of spaced apart tongues 256 and 258 (best illustrated in FIG. 11) each having spaced apart interior retaining wall (comparable to 238 illustrated in FIG. 12C) with a channel (comparable to 240 illustrated in FIG. 12C) between the interior retaining wall and reflector 250. The second width-wise edge 220 of diffuser 200 is removably received within and retained in the respective channels of tongues 257 and 259 and pressed between the respective retaining wall of the tongue and the reflector. Gripping finger 226 rests just below second reflector 250.

The diffuser lens 200 is retained by the two reflectors 230 and 250 by a press fit. When in place, the interior of the diffuser lens 200 is sealed so dirt and debris cannot enter the interior of the diffuser lens. To remove the diffuser lens 200, an outwardly directly force toward the first transverse wall 16 or second transverse wall 48 on a gripping finger 216 or 226 overcomes the press fit retention to remove the diffuser lens 200.

A unique innovation that as light from the multiplicity of LEDs such as 104, 114, 124, 134 and 144 shines through the diffuser 200, some of the light goes directly through the diffuser 200 and some of the light, especially from the arcuate angled LEDs 134 and 144 will bounce off the arcuate reflectors 230 and 250 and give a glowing effect to the fixture 10. As a result, through the use of the diffuser 200, the LEDs mimic a fluorescent light and the incorporation of arcuate reflectors on either side of the diffuser provides a glowing effect to the light in addition to mimicking a fluorescent light giving a very, very attractive appearance. The addition of the wavy interior surface 202 on the diffuser lens provides the added advantages previously discussed.

The drivers 42 and 44 through which the system is powered are affixed to the lower surface of access door 30 as previously discussed and can be accessed from above through access door 30. In addition, to gain access from below, diffuser 200 is removed by an outward force on a gripping finger 216 or 226 to remove the diffuser 200 from the arcuate reflectors 230 and 250 and then reflector 230 is removed by unscrewing fastening screws 234 to gain access to the drivers 42 and 44.

On the opposite side of the fixture is the emergency battery pack 72 which is affixed to the lower surface of access door 60 as previously discussed which enables access from above to the emergency battery pack 72. In addition, to gain access from below, diffuser 200 is removed by an outward force on a gripping finger 216 or 226 to remove the diffuser 200 from the arcuate reflectors 230 and 250 and then reflector 250 is removed by unscrewing fastening screws 254 to gain access to the emergency battery pack 72.

The purpose of the emergency battery pack 72 is to light some of the LEDs 104, 114, 124, 134 and 144 in the event power goes out so that an individual will have lighting to escape from a building should power go out. In one example, only some of the LEDs on center board 100 are lit for about 90 minutes.

The heat sink 150 is made out of aluminum and can have any desired multiplicity of fins 152.

With respect to the multiplicity of LED boards, by way of example only, there can be 12 LEDs per board. Therefore, the multiplicity of LEDs 104 on board 100 can be 12, the multiplicity of LEDs 114 on board 110 can be 12, the multiplicity of LEDs 124 on board 120 can be 12, the multiplicity of LEDs 134 on board 130 can be 12 and the multiplicity of LEDs 144 on board 140 can be 12. However, these are just examples. There can be more or less LEDs on each board and there can be a different number of LEDs on each board.

Figure 8:
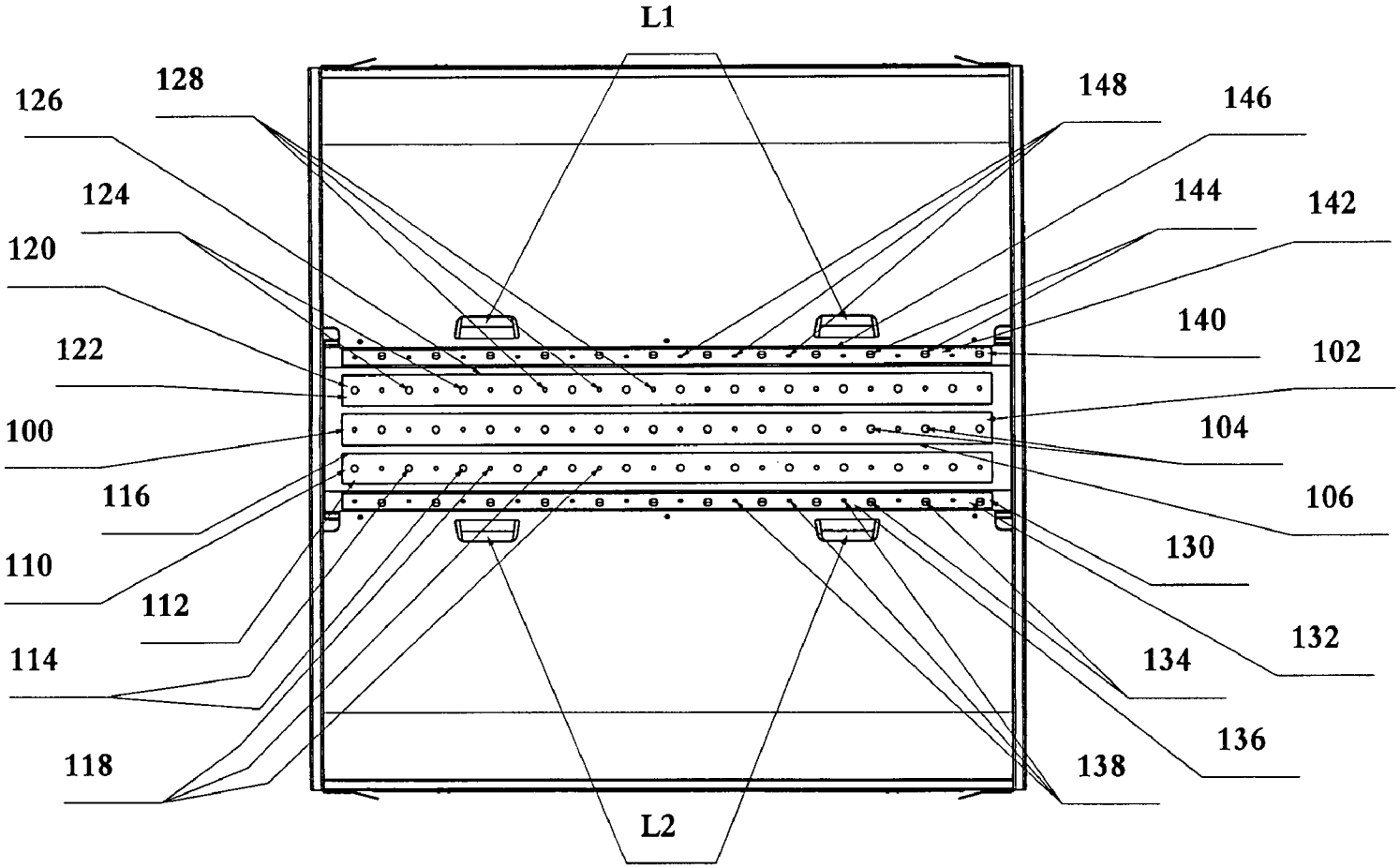
FIG. 8 is a bottom plan view of the first embodiment of the present LED direct and indirect recessed lighting fixture with the diffuser lens removed.
Figure 9:
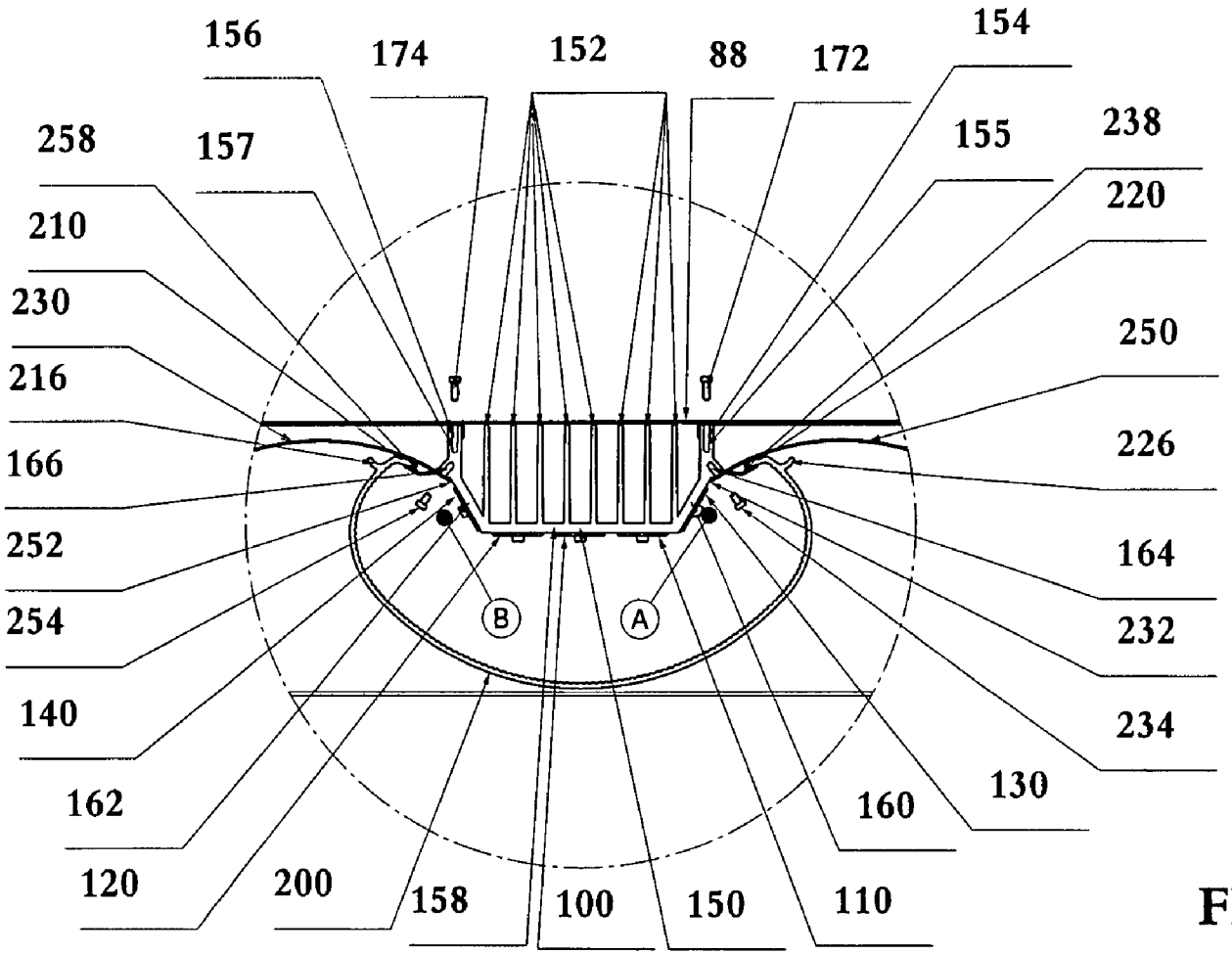
FIG. 9 is an enlarged view of the diffuser lens and heat sink taken along line 10-10 of FIG. 10.
Figure 10:
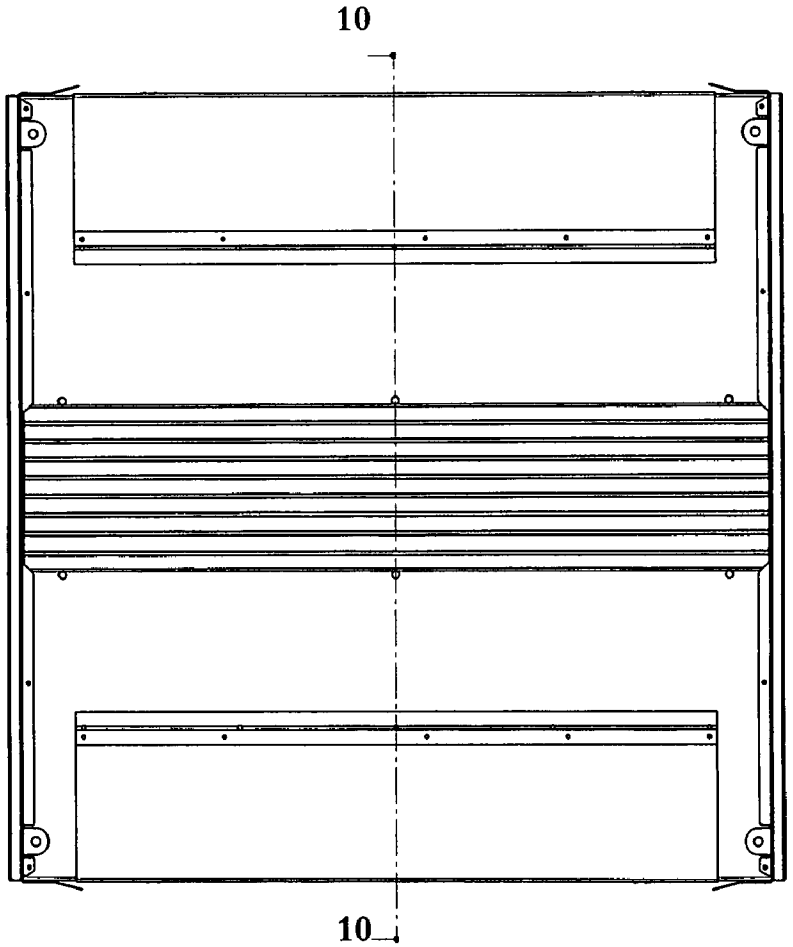
FIG. 10 is a top plan view of a first embodiment of the present invention LED direct and indirect recessed lighting fixture.

As illustrated in FIG. 8, the LEDs from one board can be staggered relative to LEDs on an adjacent board. The LEDs 104 on board 100 are staggered from the LEDs 114 on board 110 and from the LEDs 124 on board 120 and can be in line with or staggered with the LEDs 134 or 144 on boards 130 and 140 respectively. It is preferred to have the LEDs staggered instead of being aligned in a row so that they diffuse light more evenly so they are staggered at alternating rows along the length of the boards 100, 110, 120, 130 and 140. By way of example, the LED boards 100, 130 and 140 can have LEDs in one transverse row and boards 110 and 120 can have their LEDs offset. Alternatively, the LEDs can also be aligned from all of the boards or the LEDs on each board can be staggered relative to the LEDs on all of the other boards.

The LEDs 104, 114, 124, 134 and 144 are primarily white light but it is also within the spirit and scope of the present invention to have them in colors and have them in different colors. It is believed that the fact that the LEDs on a board being staggered in alternating rows is a new innovation of the present invention.

The center basket diffuser 200 is unique to the present invention.

Either or both of the drivers 42 and 44 can be a dimming driver. Alternatively, it is possible to have a dual level switch where two hot leads are brought in each switch independently that would turn on and off a subgroup of one of the subsets of the five LED boards. By way of example, a dimming LED switch would have a dimming LED driver which would have a rotating switch wherein the amounts of light emitted from each of the LEDs would be varied and could be brighter or dimmer. Alternatively, the fixture can have dual level switching where the LEDs on boards 100, 130 and 140 can be turned on with one switch and the LEDs on boards 110 and 120 can be turned on with a separate switch. This is only one example because any variation of a number of switches turning on the LEDS and respective boards is within the spirit and scope of the present invention. Therefore, it is within the spirit and scope of the present invention to have at least one board turned on with a switch and it is also possible to have two or three boards turned on with one switch and an alternatively two or three boards turned on with a second switch. Therefore, one could go full power mode or could go dimming mode on the driver.

The diffuser 200 is primarily frosted acrylic although it also could be perforated metal. For the LEDs, there are different shades of white. There is a warm white, a cool white, daylight and possibly for colored LEDs. Therefore, the LEDs 104, 114, 124, 134 and 144 can be warm white, cool white, daylight and colored.

In the case of the emergency battery pack 72, it will go on if the power goes out and at least a certain subset of the LEDs such as 8 LEDs on one board such as some of the LEDs 104 on board 100 will be lit. The special circuit design will be a nickel cadmium battery for the emergency battery pack 72 so it will last at least 90 minutes and the idea is to preserve battery life so therefore, the emergency battery will only be lighting one subset of LEDs such as 8 LEDs on one board which is preferably the center board 100 and some of the LEDs 104 thereon to provide light so that someone can exit the building in case there is an emergency.

A combination of the heat sink 150 and the arcuate reflectors 230 and 250 are unique. The heat sink 150 is in the middle and the two reflectors 230 and 250 with reflectors screwed into the heat sink is a unique feature of the present invention. The reflectors 230 and 250 are preferably made of metal. In addition to the heat traveling up into the recess above the light fixture 10 through the use of the heat sink 150 and its fins 152, the metal reflectors 230 and 250 also serve a dual purpose. In addition, to reflecting the rays of light from the LEDs giving a soft illumination effect, the arcuate reflectors 230 and 250 also act as a heat sink to dissipate the heat from the LEDs. The reflectors 230 and 250 serve to absorb the heat, thereby allowing the LEDs to run cooler with a longer life.

Accordingly, through use of the present invention, at least one and a multiplicity of LED boards can be cooled by having them affixed adjacent a heat sink and will have a diffuser surrounding the LED boards to permit the LEDs to shine with a soft warm glow. In addition, the reflectors serve to reflect the light to give it a warm glow and serve a dual purpose of dissipating heat and to assist the heat sink so that the LEDs will run cooler and have a longer life. The use of having emergency access doors to gain access to the diffuser and to the battery pack is also unique so it is not necessary to disassemble the fixture from beneath but access can be gained to the fixture from above.

Figure 13:
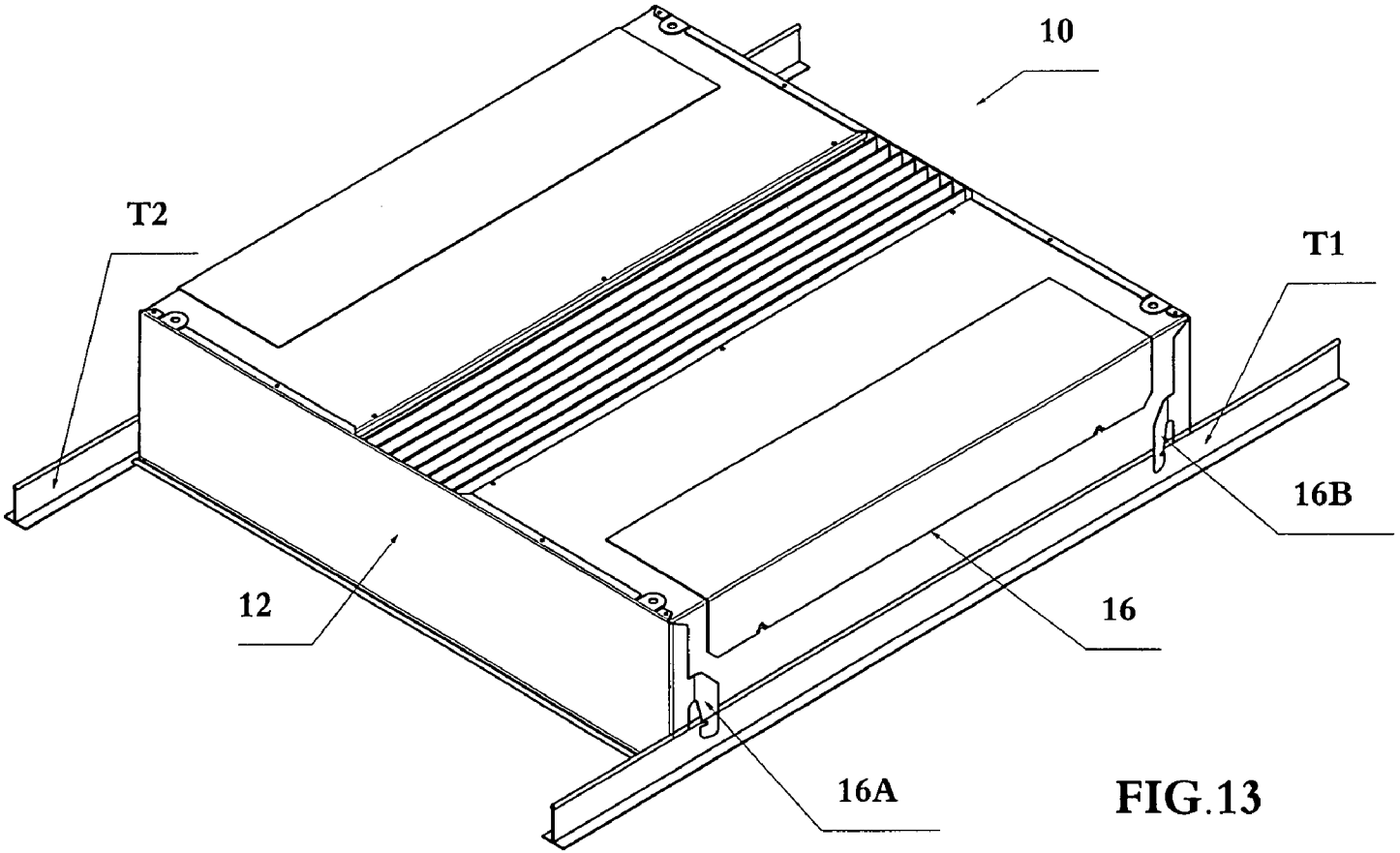
FIG. 13 is a perspective view of the first embodiment affixed to hanging bars in a ceiling recess of a structure.

The fixture is retained within the ceiling by attachment members such as 16A and 16B on transverse wall 16 and 48A and 48B on transverse wall 48. Referring to FIG. 13, these attachment members have gripping teeth to grip into respective T-bars T1 of a structure, to secure the fixture 10 in a strong way so that the fixture 10 will not come loose during an earthquake.

The present invention in FIGS. 1-13 have been described with an embodiment where the sides of the fixture are generally square such as 2 ft. by 2 ft An alternative variation is to have a longer fixture which is 2 ft. by 4 ft. which is rectangular as illustrated in FIGS. 14-26.

Figure 16:
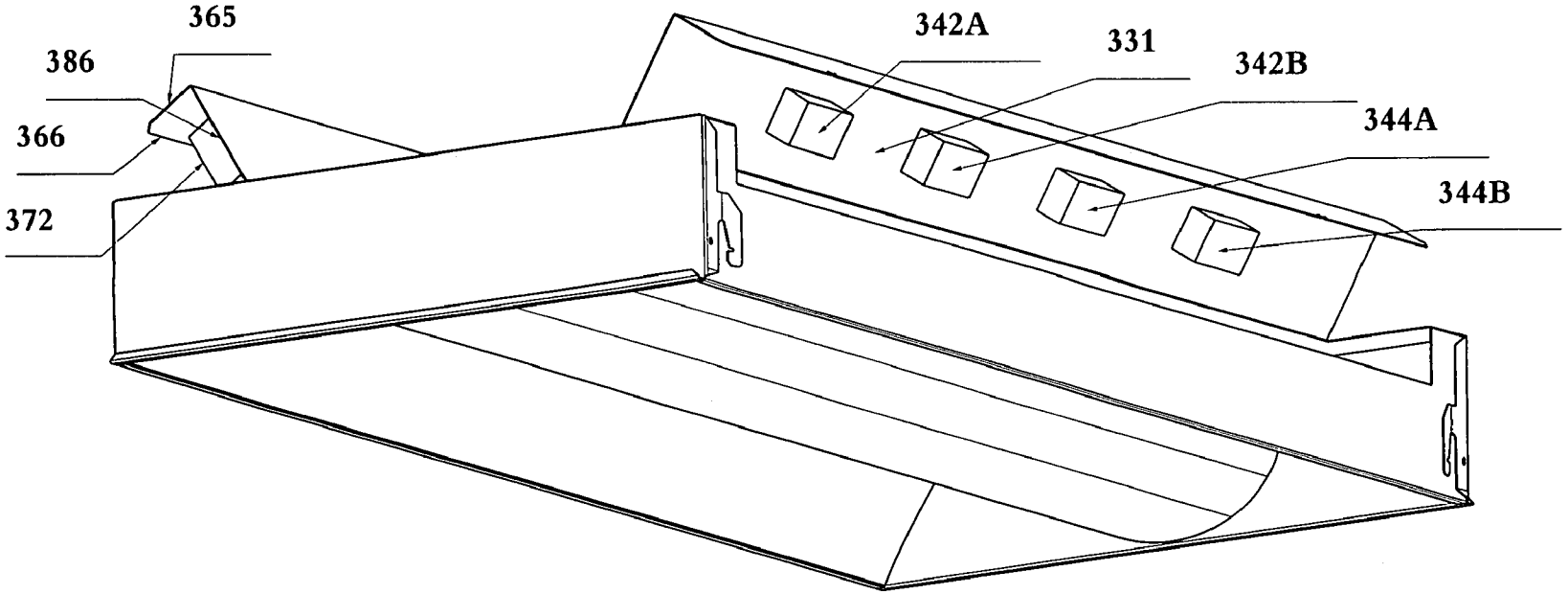
FIG. 16 is a bottom perspective view of a second embodiment of the present invention LED direct and indirect recessed lighting fixture which is generally rectangular in shape, with the emergency access doors in the opened position.
Figure 17:
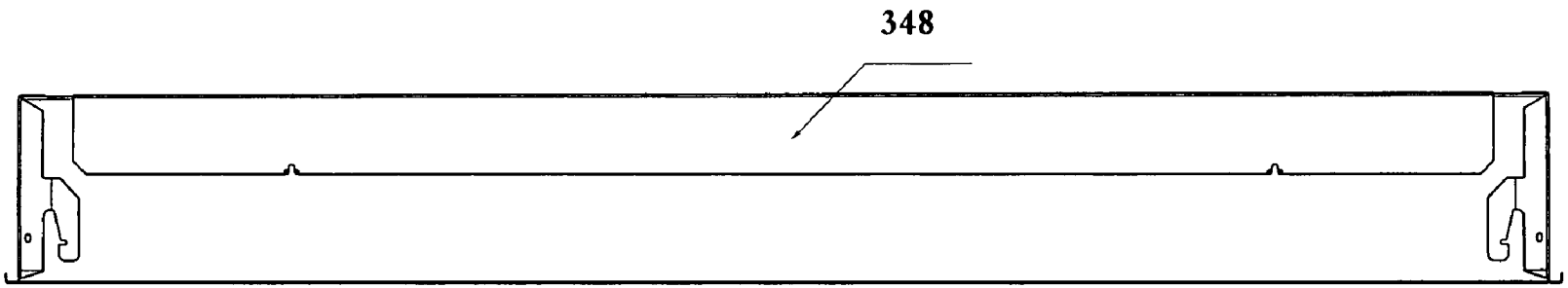
FIG. 17 is a rear elevational view of a second embodiment of the present invention LED direct and indirect recessed lighting fixture; which is generally rectangular in shape, with the emergency access doors in the opened position.
Figure 18:
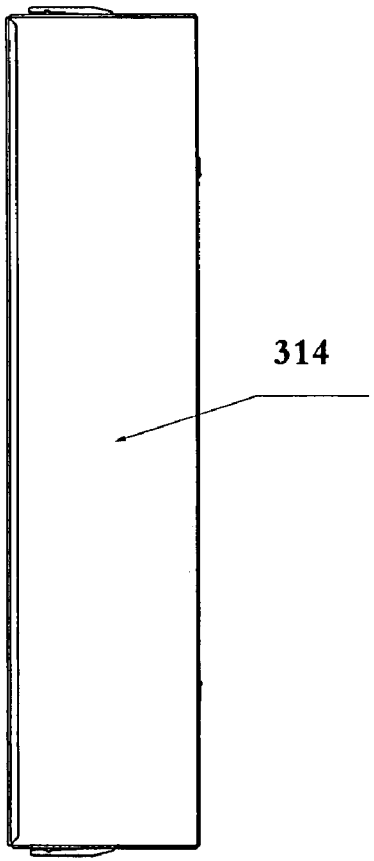
FIG. 18 is a right side front elevational view of a second embodiment of the present invention LED direct and indirect recessed lighting fixture; which is generally rectangular in shape, with the emergency access doors in the opened position.
Figure 19:
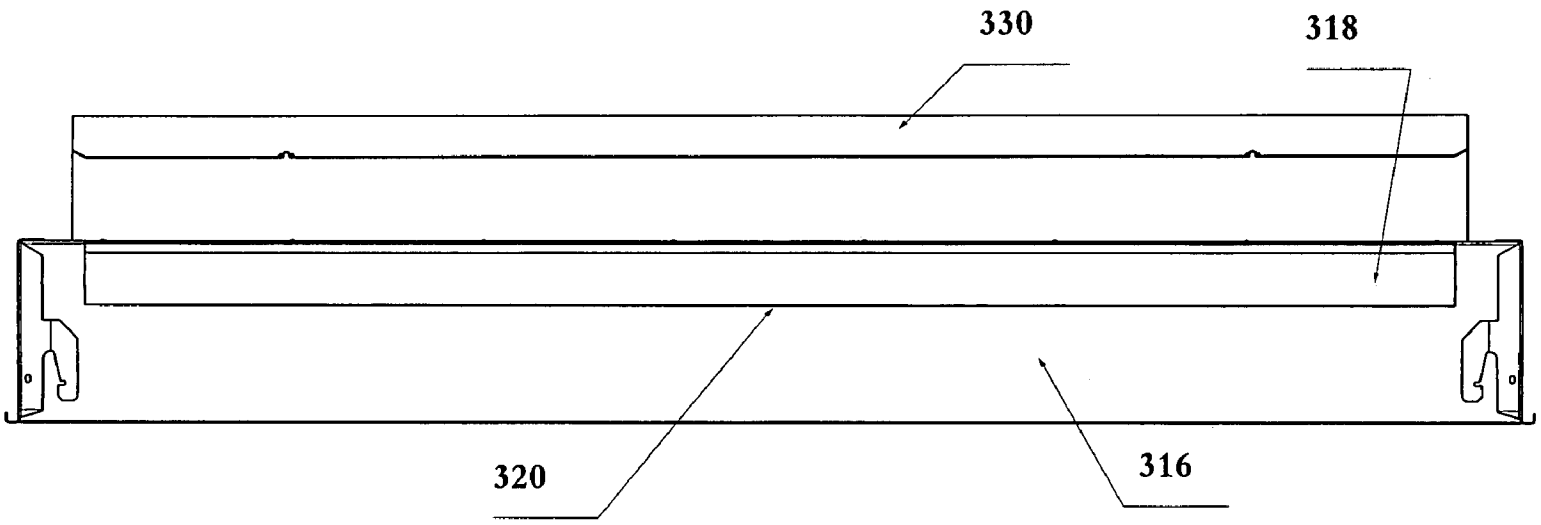
FIG. 19 is a front elevational view of a first embodiment of the present invention LED direct and indirect recessed lighting fixture; which is generally rectangular in shape, with the emergency access doors in the opened position.
Figures 25, 25A, 25B, 25C:
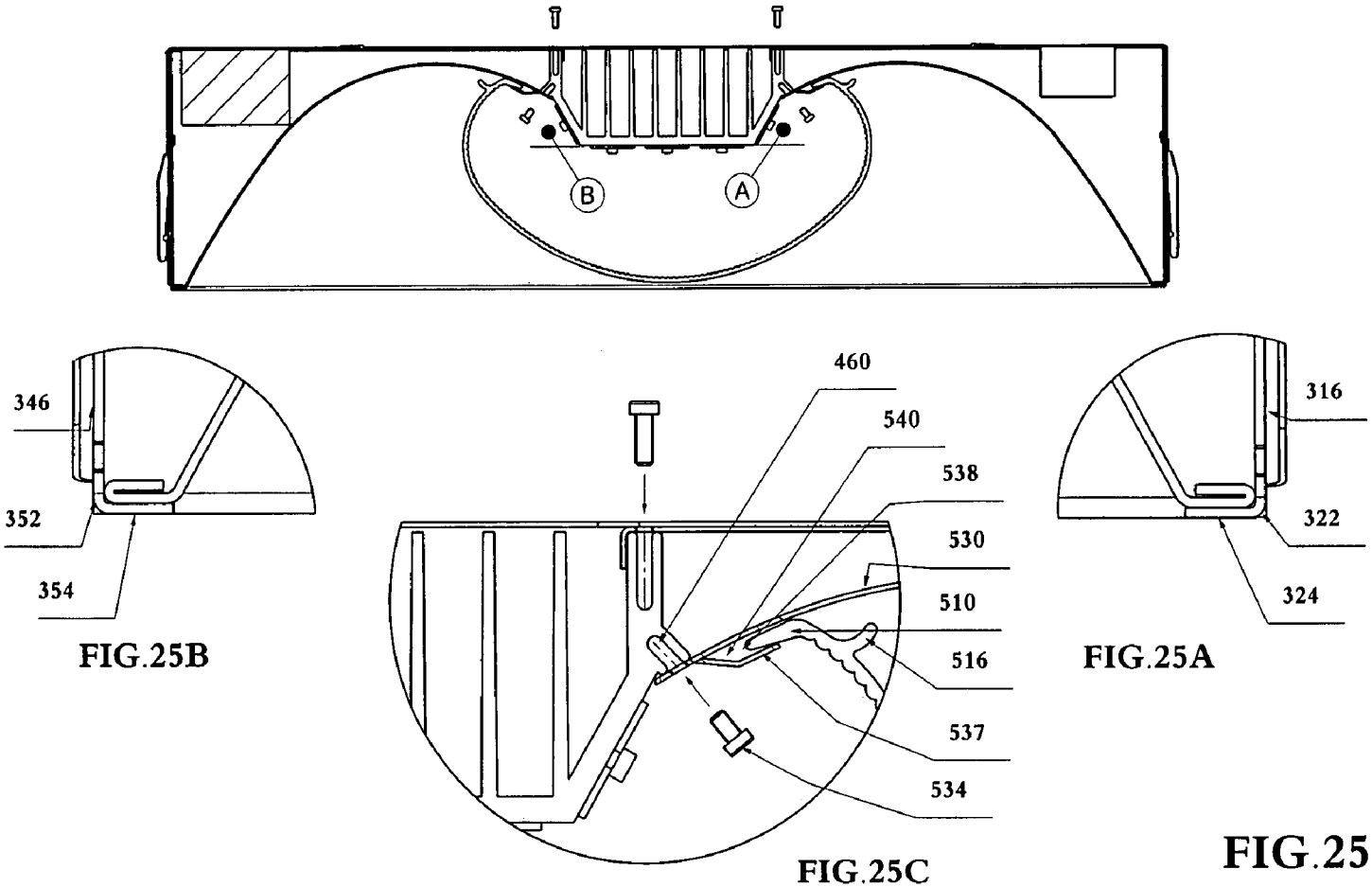
FIG. 25 is a cross-sectional view taken along line 23-23 of FIG. 23.
FIG. 25A is an enlarged detailed view of a front lower end.
FIG. 25B is an enlarged detailed view of a rear lower end.
FIG. 25C is an enlarged detailed view of the interconnection of a reflector with the heat sink.

Referring to FIGS. 14-26, there is illustrated the second embodiment of the present invention which is generally rectangular shape in length and width and can be approximately 4 feet. long by 2 feet. wide. The LED direct and indirect recessed lighting fixture 310 has a first lengthwise sidewall 312, a second parallel oppositely disposed lengthwise sidewall 314, a first transverse wall 316 and a second transverse wall 348 and a top wall 380 which form a generally rectangular shaped object. First transverse wall 316 has a top opening 318 and interior edge 320. Referring to FIG. 25A, first transverse wall 316 has a lower end wall 322 with a interiorly extending transverse lip 32. Top wall 380 has a first opening 382 with joins opening 318 in first transverse wall 316. One of the unique innovations of the present invention is a first access door 330 having a top section 332 with an interior edge 334, the top section extending to a transverse section 335 having a lower edge 336 into which are formed a pair of spaced apart fastening members or teeth 338 and 340. The interior edge 334 of top section 332 of access door 330 is affixed to a hinge 334A where top access door 330 rotatably opens about hinge 334A. The lower edge 336 of transverse section 335 is removably affixed to interior edge 320 of first transverse wall 316 by teeth 338 and 340. Referring to FIG. 16, the fixture 310 contains two pairs of spaced apart drivers 342A m 342B, 344A and 344B which are affixed to the interior surface 331 of access door 330. By incorporating first rapid access door 330, access to all drivers 342A, 342B, 344A and 344*b* can be rapidly achieved from above the fixture 310 without having to dismantle the fixture from below.

Parallel oppositely disposed second transverse wall 348 has a top opening 349 and interior edge 350. Referring to FIG. 25, second transverse wall 346 has a lower end wall 352 with a interiorly extending transverse lip 354. Top wall 380 has a second opening 384 which joins opening 349 in second transverse wall 346. A second unique innovations of the present invention is a second access door 360 having a top section 362 with an interior edge 364, the top section extending to a transverse section 365 having a lower edge 366 into which are formed a pair of spaced apart fastening members or teeth 368 and 370. The interior edge 364 of top section 362 of access door 360 rests on top wall 380 and lower edge 366 of transverse section 365 is removably affixed to interior edge 350 to second transverse wall 346 by teeth 368 and 370. The fixture 310 contains an emergency battery pack 372 which is affixed to the interior surface 386 of second access door 360. By incorporating second rapid access door 360, access to the emergency battery pack 372 can be rapidly achieved from above the fixture 10 without having to dismantle the fixture from below.

The key innovation of the present invention is that it is an LED recessed light which is designed to mimic a fluorescent light. Referring to FIGS. 20 through 25, the invention contains a multiplicity of LED boards. By way of example only, the present invention includes ten LED boards which include center horizontal LED boards 400A and 400B, 410A and 410B, and 420A and 420Ba first pair of angled LED boards 430A and 430B which extends at an angle to the horizontal LED boards 410A and 410B extending from the bottom toward the interior of the fixture and a second pair of angled LED boards 440A and 440B which extends at an angle to the horizontal LED boards 420A and 420B with pair of boards 430A and 430B and pair of board 440A and 440B extending at opposite angles to each other.

Figure 22:
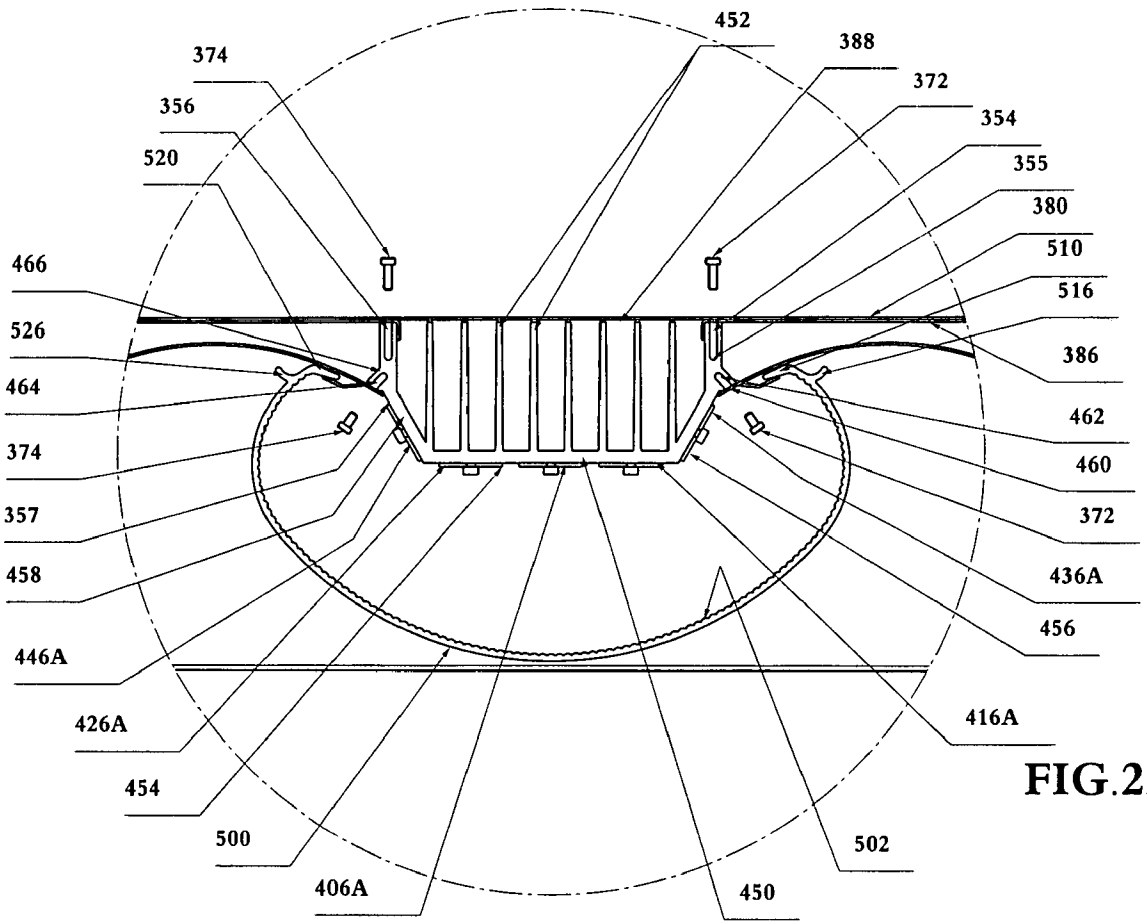
FIG. 22 is an enlarged view of the diffuser lens and heat sink taken along line 23-23 of FIG. 23.
Figure 23:
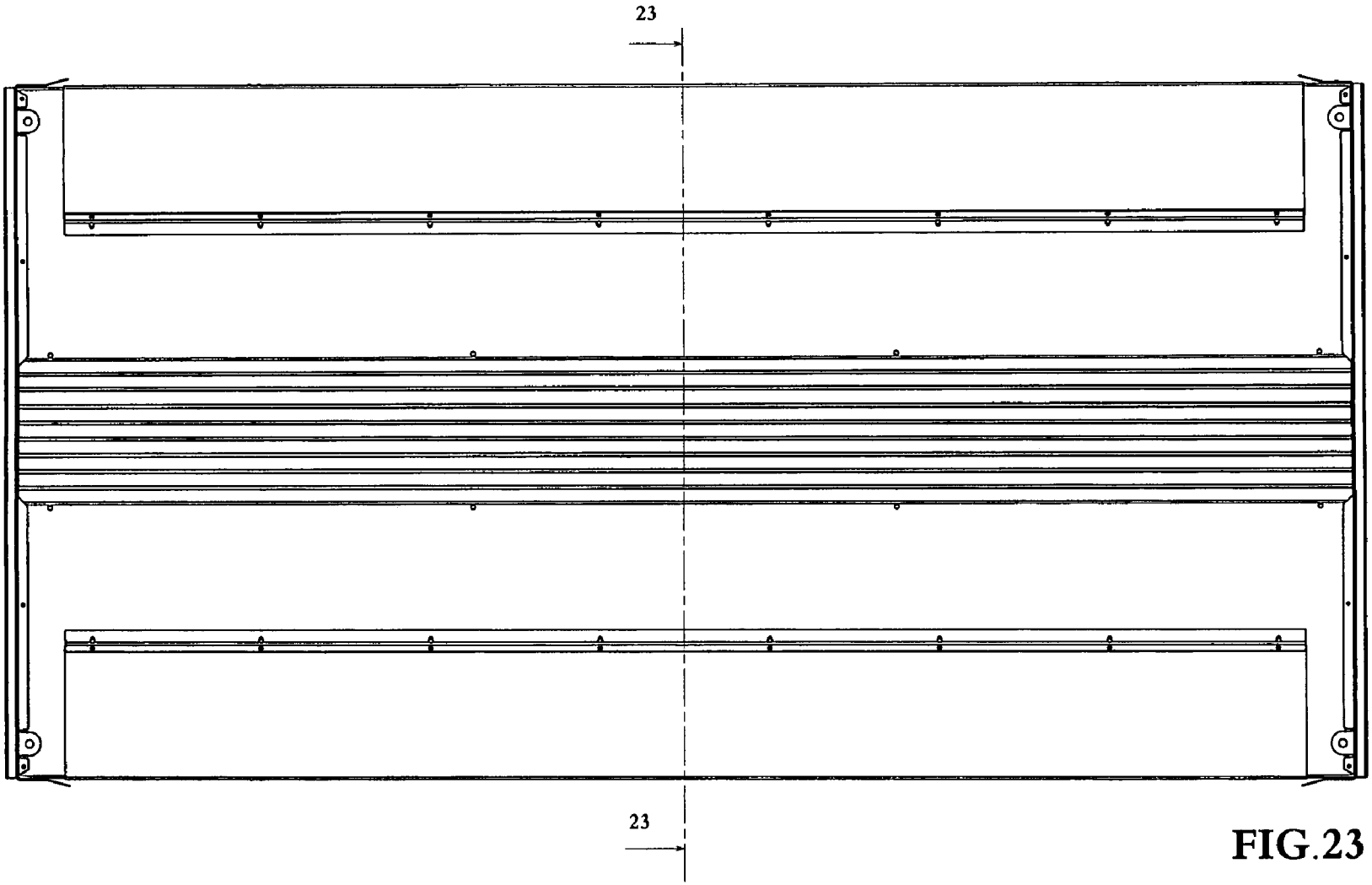
FIG. 23 is a top plan view of a second embodiment of the present invention LED direct and indirect recessed lighting fixture.
Figure 24A:
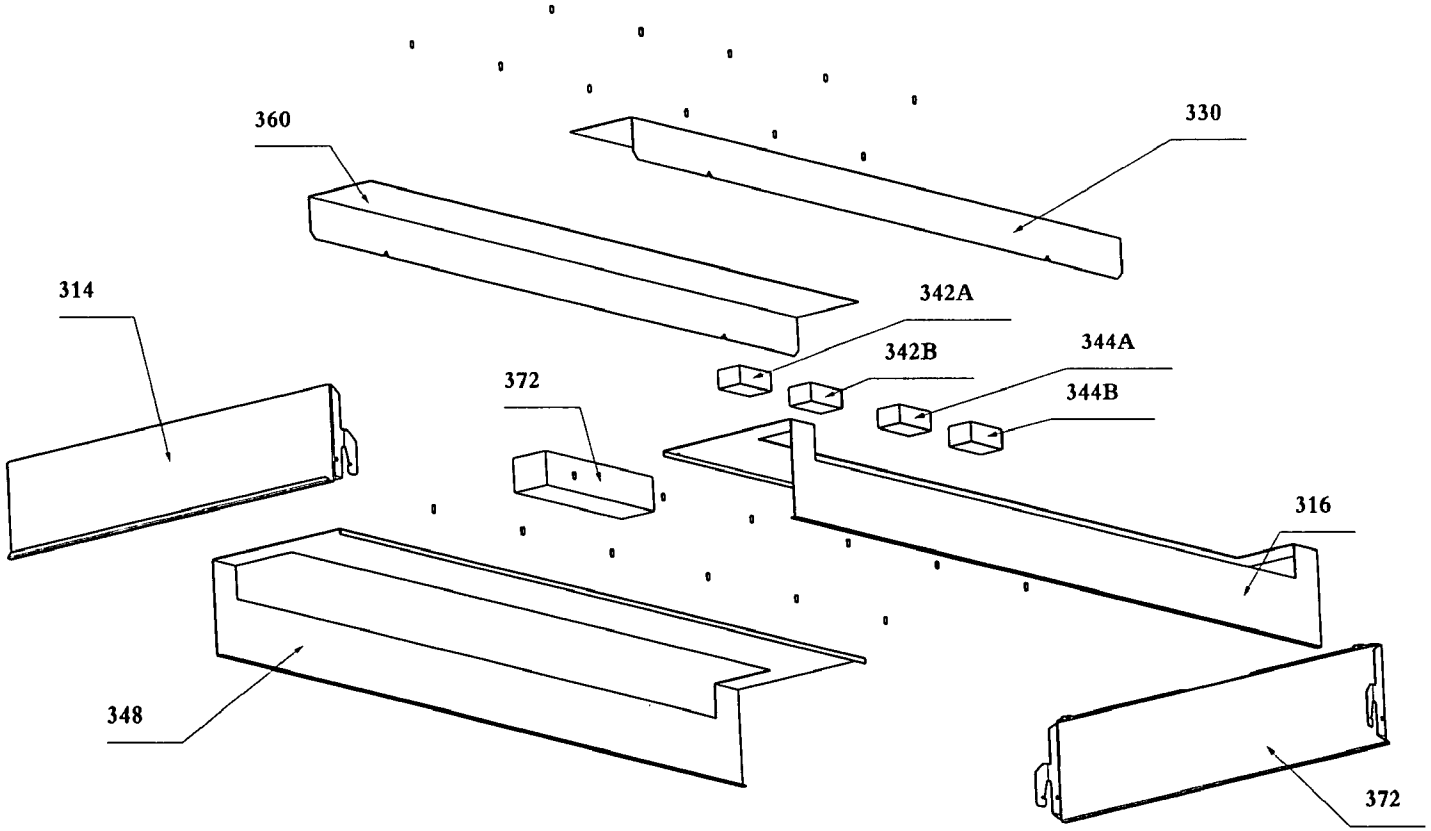
FIGS. 24A and 24B are exploded views illustrating the opponents of the second embodiment of the present invention LED direct and indirect recessed lighting fixture.
Figure 24B:
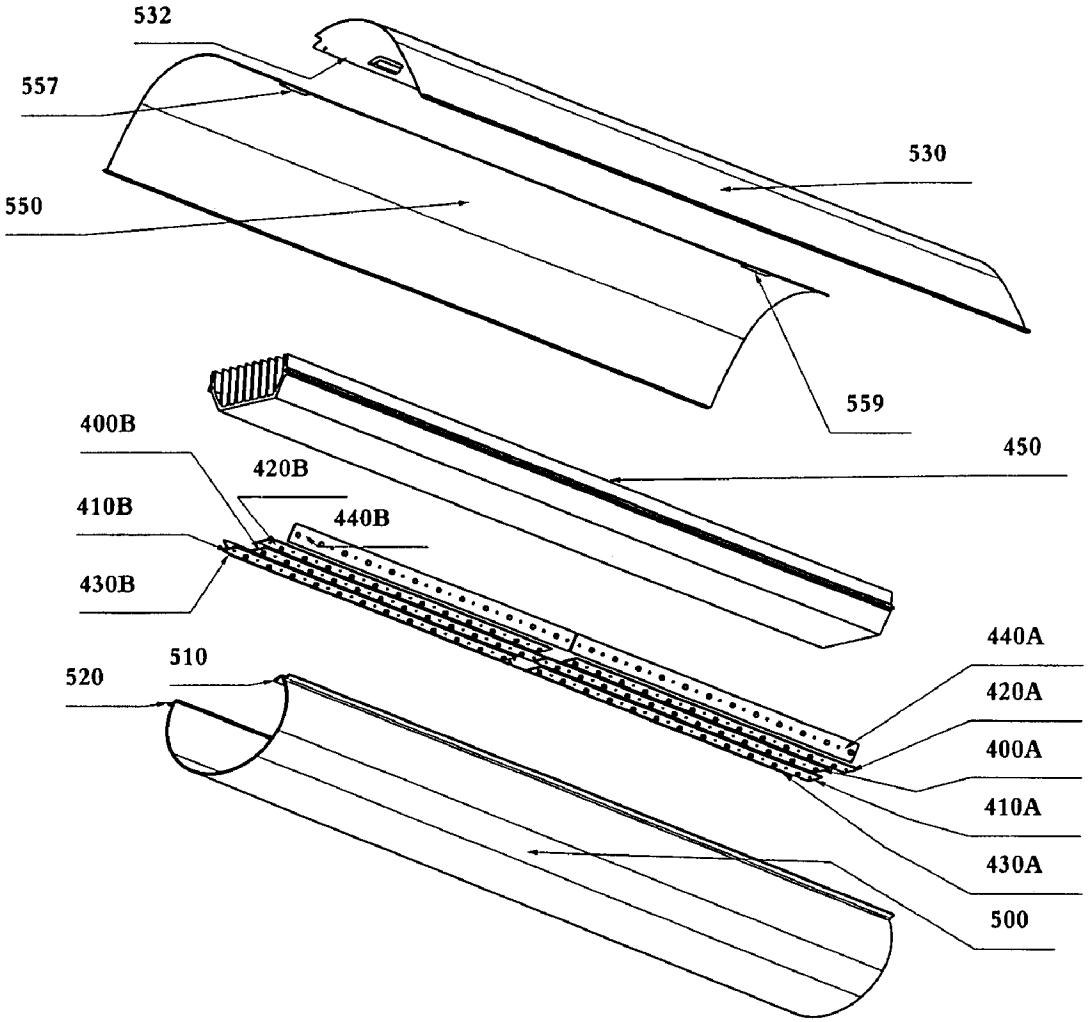

As illustrated in FIG. 22, by way of example, the first pair of angled LED board 430A and 430B can extend at an angle "C" which is approximately 60 degrees to the horizontal and second pair of angled LED board 440A and 440B also extends at an oppositely disposed angle "D" which also is approximately 60° to the horizontal. It will appreciated that angle "C" and angle "D" can range from 0° to 80°. The first center horizontal LED boards 400A and 400B respectively have a lower surface 402A and 402B with a multiplicity of LEDs 404A and 404B thereon, and respective upper surfaces 406A and 406B. The second center horizontal LED boards 410A and 410B respectively have a lower surface 412A and 412B with a multiplicity of LEDs 414A and 414B thereon, and respective upper surfaces 416A and 416B. The third center horizontal LED boards 420A and 420B respectively have a lower surface 422A and 412B with a multiplicity of LEDs 424A and 424B thereon, and respective upper surfaces 426A and 426B.

The first pair of angled LED boards 430A and 430B respectively have a lower surface 432A and 432B respectively having a multiplicity of LEDs 434A and 434B thereon, and a respective upper surface 436A and 436B. The second pair of angled LED boards 440A and 440B respectively have a lower surface 442A and 442B which respectively have a multiplicity of LEDs 444A and 444B thereon, and a respective upper surface 446A and 446B.

The LED boards are affixed to a heat sink 450 having a multiplicity of fins 452 thereon which serve to dissipate heat from the LEDs. As illustrated in FIG. 1, the multiplicity of fins 452 of the heat sink 450 extend out of a center opening 388 in top wall 380 so that the heat can be dissipated into the area above the recessed lighting fixture 310. The heat sink has a first upper vertical interior channel 454 and a spaced second vertical interior channel 456 as illustrated in FIG. 22. The heat sink is affixed to the top wall 380 by respective fastening screws 472, 474, extending through corresponding openings in top wall 380 and threaded into respective interior channels 454 and 456 so that the exterior top ends of heat sink 450 rest just below lower surface 386 of top wall 380 while the multiplicity of fins 452 extend out of top opening 388 in top wall 380.

Interior channel 354 is formed into first width-wise sidewall 355 of heat sink 350. Interior channel 315 is formed into second width-wise side 357 of heat sink 350. There can be at least two sets of screws 372 and 374 and preferably as illustrated in FIG. 14, three sets of spaced apart screws 372 and 374 evenly spaced along the width of the fixture, with one in the approximate center and two adjacent respective sidewalls.

The heat sink has a bottom wall 454 to which top surfaces 402A, 402B, 412A, 412*b*, 424A and 424B of the horizontally oriented LED boards 400A, 400B, 410A. 410B, 420A and 420B are affixed. The heat sink has a first angled bottom wall 456 to which the top surfaces 432A and 432B of first pair of angled LED boards 430A and 4309B are affixed. The heat sink has an oppositely disposed second angled bottom wall 458 to which the top surfaces 442A and 442B of second pair of angled LED boards 440A and 440B are affixed. All three bottom walls 454, 456 and 458 are connected to at least one of the multiplicity of fins 452 of the heat sink 450. The heat sink also includes a first angled lower interior channels 460 within at first width-wise side 462 of heat sink 450, and an oppositely disposed second angled lower interior channel 464 within second width-wise side 466 of heat sink 450. The angled lower channels are preferably at an angle of 45 degrees to the horizontal.

Figure 14:
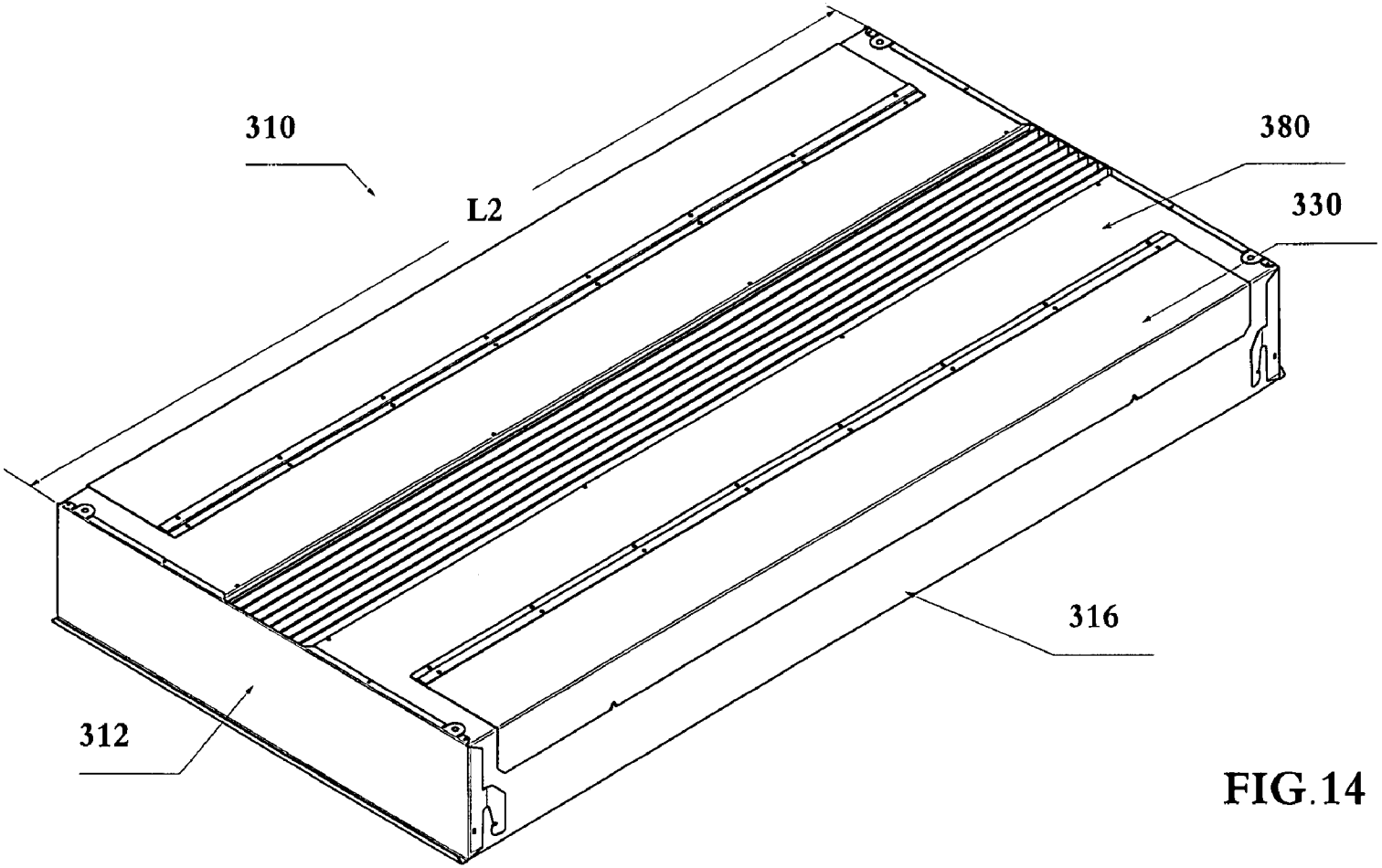
FIG. 14 is a top perspective view of a second embodiment of the present invention LED direct and indirect recessed lighting fixture which is generally rectangular in shape, with the emergency access doors in the closed position.
Figure 15:
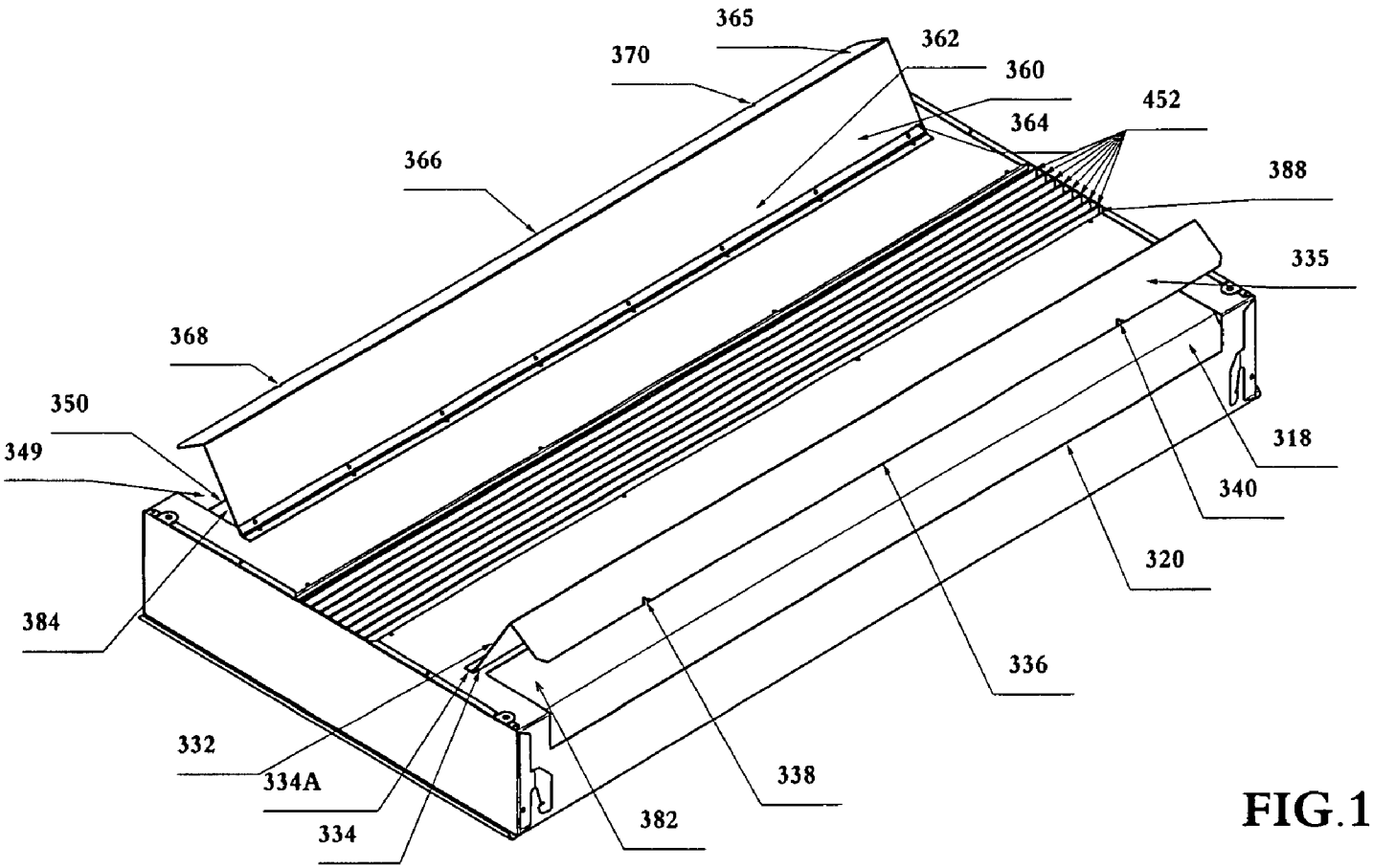
FIG. 15 is a top perspective view of a second embodiment of the present invention LED direct and indirect recessed lighting fixture which is generally rectangular in shape, with the emergency access doors in the opened position.
Figures 20, 20A, 20B:
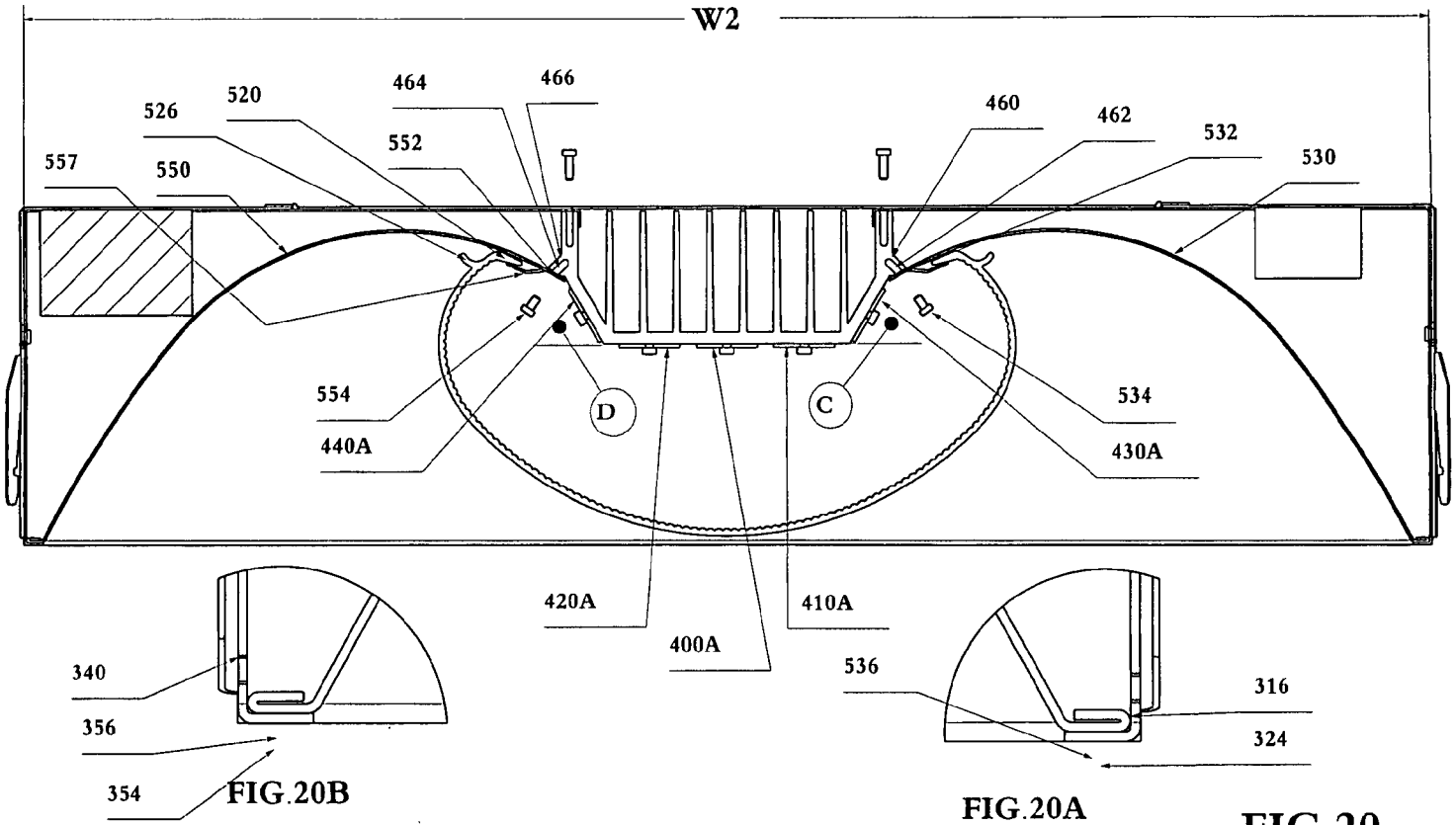
FIG. 20 is a cross-sectional view taken along line 23-23 of FIG. 23.
FIG. 20A is an enlarged detailed view of a front lower end.
FIG. 20B is an enlarged detailed view of a rear lower end

Referring to FIG. 14, the fixture 310 has a given interior length "L2". In a preferred embodiment, the heat sin k 450 extends for the entire interior length of the fixture 310. Referring to FIG. 20, the fixture 410 has a given interior width "W2". In a preferred embodiment, the heat sink 450 is positioned in the middle of the fixture 310. In a preferred embodiment, the heat sink 450 is entirely within the fixture 310.

It will be appreciated that while ten LED boards are illustrated, it is within the spirit and scope of the present invention to have at least one LED board, and preferably at least three LED boards with one being a horizontally disposed board and the other two LED boards being disposed at an angle to the horizontally disposed board and extending at opposite angles to each other as illustrated in the cross-sectional view of FIG. 22. It is also within the spirit and scope of the present invention to have three horizontally aligned LED boards as in the first embodiment and two angled LED boards. Regardless of the configuration, the LED boards are all affixed to the heat sink 450 with fins 452 so that the heat from the LEDs can be dissipated out of the fixture 310 and into the area above where the fixture is located in the ceiling of a structure.

One of the unique innovations of the present invention is that the LED boards 400A, 4008, 410A, 410B, 420A, 420B 430A, 430B, 440A and 440B, are shrouded in a frosted acrylic or perforated metal diffuser lens 500 which is in the shape of a longitudinal basket extending the entire interior width of the fixture 310 and which serves to diffuse the light from the LEDs. The light from the LEDs is transmitted through the diffuser lens 500. An additional improvement is the incorporation of a wavy interior surface 502 on the interior of the diffuser lens 500. The wavy interior surface causes the lights form the LEDs to bounce off the wavy surface and provide a smooth warm illumination glow. The wavy surface also serves tot hide the spot locations where illumination from the LEDs are emitted.

As best illustrated in FIG. 22, the diffuser lens 500 is arc shaped having a first width-wise edge 510 and a gripping finger 516 spaced apart form width-wise edge 210 and extending at an upward angle from diffuser lens 500. The diffuser lens 500 also has a parallel oppositely disposed second width-wise edge 520 and a gripping finger 526 spaced apart form width-wise edge 220 and extending at an upward angle from diffuser lens 500.

Another innovation of the present invention is the incorporation of a first arcuate reflector 530 which extends from a location adjacent one width-wise side 442 of the heat sink 450 in an arcuate shape until it terminates at a location adjacent first transverse wall 316. The arcuate reflector 530 has an interior width-wise proximal edge 532 and is removably affixed to the heat sink by a multiplicity of respective fastening screws 534 respectively screwed into first angled lower interior channel 460 of heat sink 450. At its distal end, the arcuate reflector 530 terminates in an upturned end 536 which rests on transverse lip 324 of first transverse wall 316, as best illustrated in FIG. 25A.

The first arcuate reflector has a pair of spaced apart retaining tongues 537 as illustrated in detail in FIG. 25C with a first spaced apart interior retaining wall 538 with a channel 540 between the interior retaining wall 538 and reflector wall 530. The first arcuate reflector has an identical tongue assembly at a spaced apart location. The first width-wise edge 510 of diffuser 500 is removably received within and retained in channel 540 and pressed between retaining wall 538 of each tongue 537. Gripping finger 516 rests just below first arcuate reflector 530.

It is within the spirit and scope of the present invention for the fixture 310 to include a second arcuate reflector 550 which extends from a location adjacent a second width-wise side 466 of the heat sink 450 in an arcuate shape until it terminates at a location adjacent second transverse wall 346. The arcuate reflector 550 has an interior width-wise proximal edge 552 and is removably affixed to the heat sink by a multiplicity of respective fastening screws 554 respectively screwed into second angled lower interior channels 466 of heat sink 450. At its distal end, the arcuate reflector 550 terminates in an upturned end 556 which rests on transverse lip 354 of second transverse wall 346. The second arcuate reflector has a pair of spaced apart tongues 557 and 559 each having a spaced apart retaining wall (comparable to 528) with a channel (comparable to 460 illustrated in FIG. 25C) between the interior retaining wall and reflector 550. The second width-wise edge 520 of diffuser 500 is removably received within and retained in the respective channels of tongue 557 and pressed between the respective retaining wall of the tongue and the reflector. Gripping finger 526 rests just below second reflector 550.

The diffuser lens 500 is retained by the two reflectors 530 and 550 by a press fit. When in place, the interior of the diffuser lens 500 is sealed so dirt and debris cannot enter the interior of the diffuser lens 500. To remove the diffuser lens 500, an outwardly directly force toward the first transverse wall 316 or second transverse wall 348 on a gripping finger 516 or 19, 526 overcomes the press fit retention to remove the diffuser lens 500.

A unique innovation that as light from the multiplicity of LEDs such as 404A, 404B, 414A, 414B, 424A, 424B, 434A, 434B and 444A and 44B shines through the diffuser 500, some of the light goes directly through the diffuser 500 and some of the light, especially from the arcuate angled LEDs 434A and 434B and 444A and 444B will bounce off the arcuate reflectors 530 and 550 and give a glowing effect to the fixture 310. As a result, through the use of the diffuser 500, the LEDs mimic a fluorescent light and the incorporation of arcuate reflectors on either side of the diffuser provides a glowing effect to the light in addition to mimicking a fluorescent light giving a very, very attractive appearance.

The drivers 442A. 442B, 444A and 444B through which the system is powered is located adjacent the top wall 380 of fixture 310 and as previously discussed, can be accessed from above through access door 330. In addition, to gain access from below, diffuser 500 is removed by an outward force on a gripping finger 516 or 526 to remove the diffuser 500 for the arcuate reflectors 530 and 550 and then reflector 530 is removed by unscrewing fastening screws 534 to gain access to the drivers.

On the opposite side of the fixture is the emergency battery pack 372 which is affixed to the lower surface of access door 360 as previously discussed which enables access from above the fixture. In addition, to gain access from below, diffuser 500 is removed by an outward force on a gripping finger 516 or 526 to remove the diffuser 500 from the arcuate reflectors 530 and 550 and then reflector 550 is removed by unscrewing fastening screws 554 to gain access to the emergency battery pack 372.

The purpose of the emergency battery pack 372 is to light some of the LEDs 404A, 404B in the event power goes out so that an individual will have lighting to escape from a building should power go out.

The heat sink 450 is made out of aluminum and can have any desired multiplicity of fins 452.

With respect to the multiplicity of LED boards, by way of example only, there can be 12 LEDs per board. Therefore, the multiplicity of LEDs 404A on board 400A can be 12, the multiplicity of LEDs 434A on board 430A can be 12 and the multiplicity of LEDs 444A on board 440A can be 12. This also applies to the other boards. However, these are just examples. There can be more or less LEDs on each board and there can be a different number of LEDs on each board.

Figure 21:
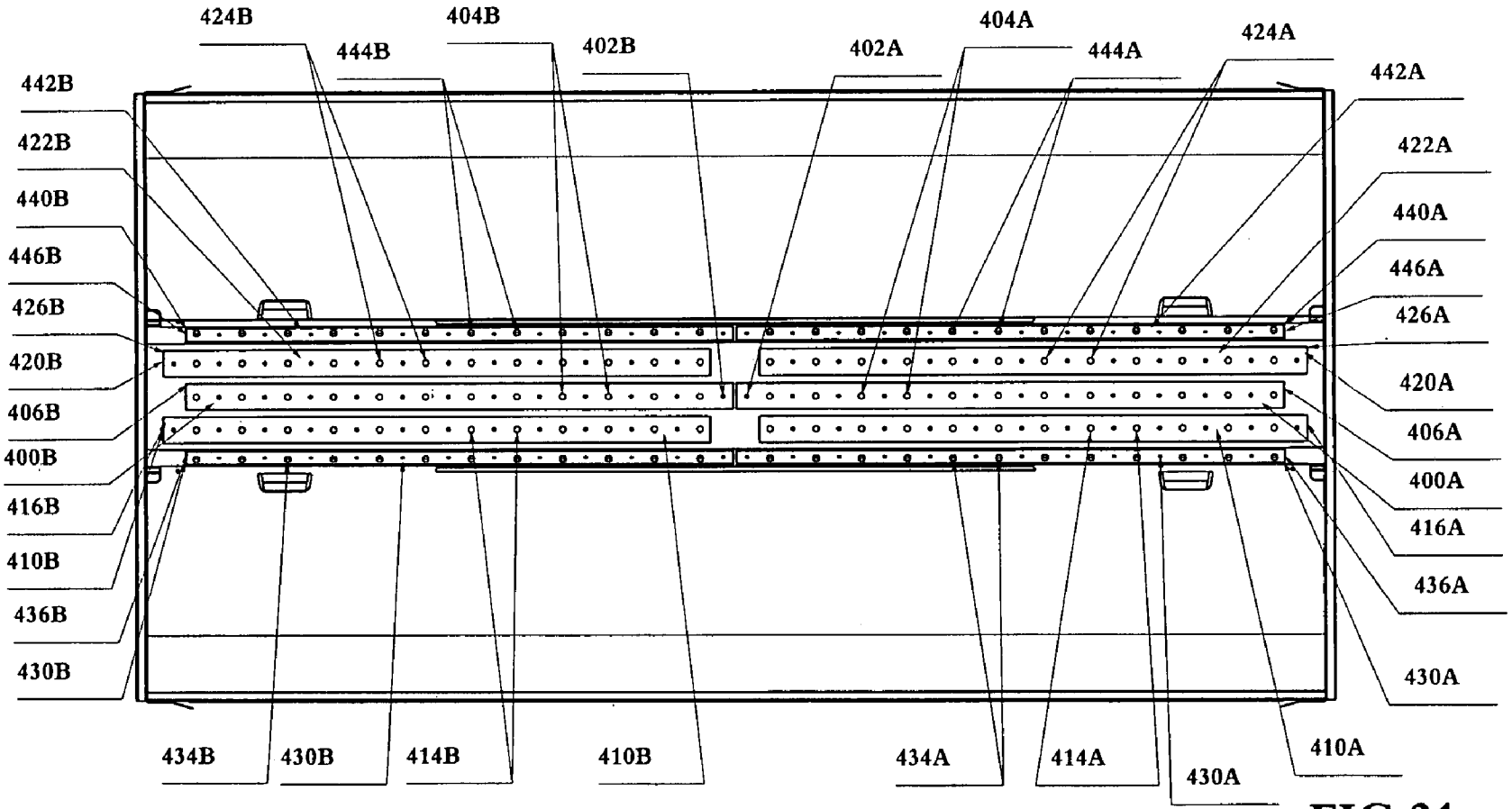
FIG. 21 is a bottom plan view of the second embodiment of the present LED direct and indirect recessed lighting fixture with the diffuser lens removed.

As illustrated in FIG. 21, the LEDs from one board can be aligned relative to LEDs on an adjacent board. It is preferred to have the LEDs staggered instead of being aligned in a row so that they diffuse light more evenly so they are staggered at alternating rows along the length of the boards 400, 410, 420 430 and 440. Alternatively, the LEDs can also be aligned from all of the boards or the LEDs on each board can be staggered relative to the LEDs on all of the other boards.

The LEDs 404A, 404B, 414A, 414B, 424A, 424B, 434A, 434B, 444A and 444B are primarily white light but it is also within the spirit and scope of the present invention to have them in colors and have them in different colors. It is believed that the fact that the LEDs on a board being staggered in alternating rows is a new innovation of the present invention.

The center basket diffuser 500 is unique to the present invention.

Either or several of the drivers 342A, 342B, 344A and 344B can be a dimming driver. Alternatively, it is possible to have a dual level switch where two hot leads are brought in each switch independently that would turn on and off a subgroup of one of the subsets of the five LED boards. By way of example, a dimming LED switch would have a dimming LED driver which would have a rotating switch wherein the amounts of light emitted from each of the LEDs would be varied and could be brighter or dimmer. Alternatively, the fixture can have dual level switching where the LEDs on board 400A, 400B, 410A, 410B, 420A and 420B, can be turned on with one switch and the LEDs on boards 430A and 430B and 440A and 440B can be turned on with a separate switch. This is only one example because any variation of a number of switches turning on the LEDS and respective boards is within the spirit and scope of the present invention. Therefore, it is within the spirit and scope of the present invention to have at least one board turned on with a switch and it is also possible to have two or three boards turned on with one switch and an alternatively two or three boards turned on with a second switch. Therefore, one could go full power mode or could go dimming mode on the driver.

The diffuser 500 is primarily frosted acrylic although it also could be perforated metal. For the LEDs, there are different shades of white. There is a warm white, a cool white, daylight and possibly for colored LEDs. Therefore, the LEDs can be warm white, cool white, daylight and colored.

In the case of the emergency battery pack 372, it will go on if the power goes out and at least a certain subset of the LEDs such as 8 LEDs on one board such as some of the LEDs 404A on board 400A will be lit. The special circuit design will be a nickel cadmium battery for the emergency battery pack 372 so it will last at least 90 minutes and the idea is to preserve battery life so therefore, the emergency battery will only be lighting one subset of LEDs such as 8 LEDs on one board which is preferably a center board 400A and some of the LEDs 404A thereon to provide light so that someone can exit the building in case there is an emergency.

A combination of the heat sink 450 and the arcuate reflectors 530 and 550 are unique. The heat sink 450 is in the middle and the two reflectors 530 and 550 with reflectors screwed into the heat sink is a unique feature of the present invention. The reflectors 530 and 50 are preferably made of metal. In addition to the heat traveling up into the recess above the light fixture 310 through the use of the heat sink 450 and its fins 452, the metal reflectors 530 and 550 also serve a dual purpose. In addition, to reflecting the rays of light from the LEDs giving a soft illumination effect, the arcuate reflectors 530 and 550 also act as a heat sink to dissipate the heat from the LEDs. The reflectors 530 and 550 serve to absorb the heat, thereby allowing the LEDs to run cooler with a longer life.

Accordingly, through use of the present invention, at least one and a multiplicity of LED boards can be cooled by having them affixed adjacent a heat sink and will have a diffuser surrounding the LED boards to permit the LEDs to shine with a soft warm glow. In addition, the reflectors serve to reflect the light to give it a warm glow and serve a dual purpose of dissipating heat and to assist the heat sink so that the LEDs will run cooler and have a longer life. The use of having emergency access doors to gain access to the diffuser and to the battery pack is also unique so it is not necessary to disassemble the fixture from beneath but access can be gained to the fixture from above.

Figure 26:
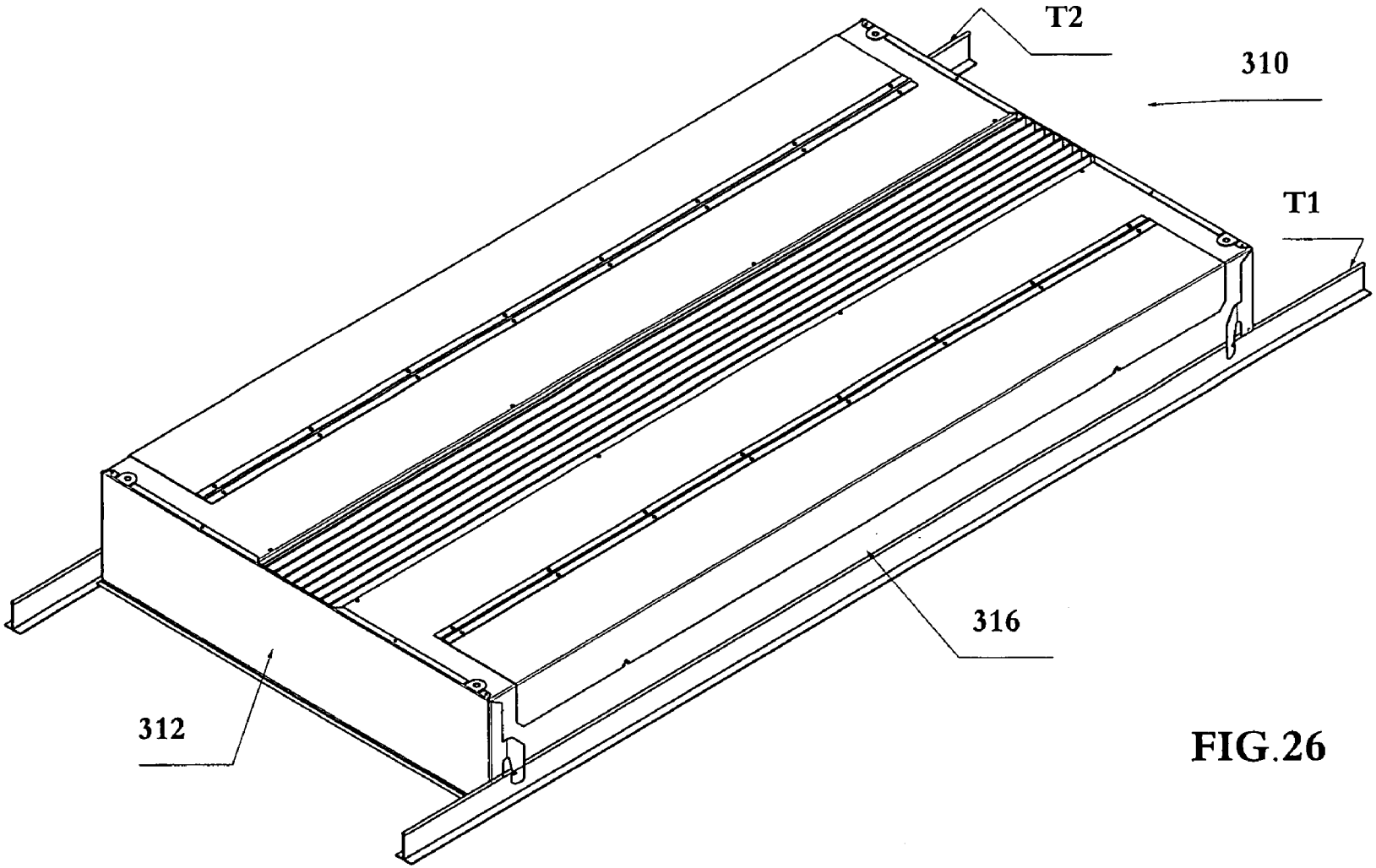
FIG. 26 is a perspective view of the second embodiment affixed to hanging bars in a ceiling recess of a structure.

The fixture is retained within the ceiling by attachment members such as 316A and 316B on transverse wall 316 and 348A and 348B on transverse wall 348. Referring to FIG. 26, these attachment members having gripping teeth to grip into respective T bars T1 and T2 of a structure, to secure the fixture 310 in a strong way so that the fixture 310 will not come loose during an earthquake.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. An LED recessed lighting fixture comprising:

a. a housing having a first lengthwise sidewall, a second oppositely disposed lengthwise sidewall, a first transverse wall, a second transverse wall, a top wall, and a first opening in the top wall adjoining an opening in the first transverse wall with a first access door hingeably affixed to the top wall and covering the adjoined openings, a second opening in the top wall adjoining an opening in the second transverse wall with a second access door hingeably affixed to the top wall and covering the adjoined openings;

b. a multiplicity of LED boards including a center horizontal LED board, a first side bottom LED board located adjacent to a first lengthwise side of the center horizontal LED board, a second side bottom LED board located adjacent to a second lengthwise side of the center horizontal LED board, a first angled LED board adjacent first side bottom LED board and extending at an angle to the first side bottom LED board and a second angled LED board adjacent second side bottom LED board and extending at an angle to the second side bottom LED board, all LED boards affixed on one side to a heat sink and having a multiplicity of LEDs on a respective opposite side of each LED board, the heat sink having a multiplicity of fins which terminate adjacent the top wall;

c. a first arcuate reflector removably retained within the fixture and extending from a location adjacent one side of the heat sink to a location adjacent first transverse wall, a second arcuate reflector removably retained within the fixture and extending from a location adjacent an opposite side of the heat sink to a location adjacent to the second transverse wall, a diffuser removably retained within the fixture and extending over all of the LED boards so that illumination from the LEDs shine through the diffuser, some illumination from the LEDs is reflected off the first arcuate reflector and some illumination from the LEDs is reflected off the second arcuate reflector;

d. a driver housed within the fixture so that it is accessible from the first access door and is also accessible by removing the diffuser and at least one arcuate reflector; and e. an emergency battery housed within the fixture so that it is accessible from the second access door and is also accessible by removing the diffuser and at least one arcuate reflector.

2. The LED recessed lighting fixture in accordance with claim 1 further comprising: the diffuser being frosted and made of acrylic material.

3. The LED recessed lighting fixture in accordance with claim 1 further comprising: the diffuser being made of perforated metal.

4. The LED recessed lighting fixture in accordance with claim 2 further comprising the diffuser having a wavy interior surface.

5. The LED recessed lighting fixture in accordance with claim 1 further comprising:

a. the first angled LED board extending at an angle between 0 degrees and 80 degrees; and b. the second angled LED board extending at an angle between 0 degrees and 860 degrees.

6. The LED recessed lighting fixture in accordance with claim 1 further comprising the sidewalls and transverse walls of the housing forming a generally square shape.

7. The LED recessed lighting fixture in accordance with claim 1 further comprising: the diffuser having a first width-wise side retained by a press fit by the first arcuate reflector and the diffuser having a second width-wise side retained by a press fit by the second arcuate reflector.

8. The LED recessed lighting fixture in accordance with claim 1 further comprising: the multiplicity of LEDs on the center horizontal LED board are offset from the multiplicity of LEDs on the first side bottom LED board and also offset from the multiplicity of the LEDs on the second side bottom LED board.

9. The LED recessed lighting fixture in accordance with claim 1 where during a power failure in which power to the fixture is interrupted, the emergency battery will enable a selected few of the LEDs on one of the LED boards to provide illumination for a given period of time.

10. The LED recessed lighting fixture in accordance with claim 1 further comprising dimming means by which the illumination from at least some of the LEDs is dimmed.

11. The LED recessed lighting fixture in accordance with claim 1 further comprising means to cause only LEDs from selected LED boards to illuminate while LEDs on some LED boards do not illuminate.

12. The LED recessed lighting fixture in accordance with claim 1 further comprising gripping teeth means on the fixture sidewall to grip beams in a structure to prevent the fixture from coming loose during an earthquake.

13. An LED recessed lighting fixture comprising:

a. a housing having a first lengthwise sidewall, a second oppositely disposed lengthwise sidewall, a first transverse wall, a second transverse wall, a top wall, and a first opening in the top wall adjoining an opening in the first transverse wall with a first access door hingeably affixed to the top wall and covering the adjoined openings, a second opening in the top wall adjoining an opening in the second transverse wall with a second access door hingeably affixed to the top wall and covering the adjoined openings;

b. a multiplicity of LED boards including a pair of center horizontal LED boards, a first pair of side bottom LED boards respectively located adjacent to a first lengthwise side of the pair of center horizontal LED boards, a second pair of side bottom LED boards respectively located adjacent to a second lengthwise side of the pair of center horizontal LED boards, a first pair of angled LED boards respectively located adjacent to one of the pair of first side bottom LED boards and extending at an angle to the pair of first side bottom LED boards, and a second pair of angled LED boards respectively located adjacent to the second pair of side bottom LED boards and extending at an angle to the second pair of side bottom LED boards, all LED boards affixed on one side to a heat sink and having a multiplicity of LEDs on a respective opposite side of each LED board, the heat sink having a multiplicity of fins which terminate adjacent the top wall;

c. a first arcuate reflector removably retained within the fixture and extending from a location adjacent one side of the heat sink to a location adjacent first transverse wall, a second arcuate reflector removably retained within the fixture and extending from a location adjacent an opposite side of the heat sink to a location adjacent to the second transverse wall, a diffuser removably retained within the fixture and extending over all of the LED boards so that illumination from the LEDs shine through the diffuser, some illumination from the LEDs is reflected off the first arcuate reflector and some illumination from the LEDs is reflected off the second arcuate reflector;

d. a driver housed within the fixture so that it is accessible from the first access door and is also accessible by removing the diffuser and at least one arcuate reflector; and e. an emergency battery housed within the fixture so that it is accessible from the second access door and is also accessible by removing the diffuser and at least one arcuate reflector.

14. The LED recessed lighting fixture in accordance with claim 13 further comprising: the diffuser being frosted and made of acrylic material.

15. The LED recessed lighting fixture in accordance with claim 13 further comprising: the diffuser being made of perforated metal.

16. The LED recessed lighting fixture in accordance with claim 14 further comprising the diffuser having a wavy interior surface.

17. The LED recessed lighting fixture in accordance with claim 13 further comprising:

a. the first angled LED board extending at an angle between 0 degrees and 80 degrees; and b. the second angled LED board extending at an angle between 0 degrees and 860 degrees.

18. The LED recessed lighting fixture in accordance with claim 13 further comprising the sidewalls and transverse walls of the housing forming a generally square shape.

19. The LED recessed lighting fixture in accordance with claim 13 further comprising: the diffuser having a first width-wise side retained by a press fit by the first arcuate reflector and the diffuser having a second width-wise side retained by a press fit by the second arcuate reflector.

20. The LED recessed lighting fixture in accordance with claim 13 further comprising: the multiplicity of LEDs on the center horizontal LED board are offset from the multiplicity of LEDs on the first side bottom LED board and also offset from the multiplicity of the LEDs on the second side bottom LED board.

21. The LED recessed lighting fixture in accordance with claim 13 where during a power failure in which power to the fixture is interrupted, the emergency battery will enable a selected few of the LEDs on one of the LED boards to provide illumination for a given period of time.

22. The LED recessed lighting fixture in accordance with claim 13 further comprising dimming means by which the illumination from at least some of the LEDs is dimmed.

23. The LED recessed lighting fixture in accordance with claim 13 further comprising means to cause only LEDs from selected LED boards to illuminate while LEDs on some LED boards do not illuminate.

24. The LED recessed lighting fixture in accordance with claim 13 further comprising gripping teeth means on the fixture sidewall to grip beams in a structure to prevent the fixture from coming loose during an earthquake.

25. An LED recessed lighting fixture comprising:

a. a housing having a first lengthwise sidewall, a second oppositely disposed lengthwise sidewall, a first transverse wall, a second transverse wall, a top wall, and a first opening in the top wall adjoining an opening in the first transverse wall with a first access door hingeably affixed to the top wall and covering the adjoining openings, a second opening in the top wall adjoining and opening in the second transverse wall with a second access door hingeably affixed to the top wall and covering the adjoined openings;

b. a multiplicity of LED boards including at least one horizontally aligned LED board oriented parallel to the top wall and at least one angled LED board oriented at an angle to the at least one horizontally aligned LED board, all LED boards affixed on one side to a heat sink and having a multiplicity of LEDs on a different side of each respective LED board which is not affixed to the heat sink, the heat sink dissipating heat from the LEDs out of the housing; and c. at least one arcuate reflector retained within the housing and extending from a location adjacent one side of the heat sink to a location adjacent a sidewall, a diffuser retained within the fixture and extending over all of the LED boards so that illumination from the LEDs shine through the diffuser and some illumination from some of the LEDs is reflected off the at least one arcuate reflector.

26. An LED recessed lighting fixture in accordance with claim 25 further comprising said diffuser having a way interior surface.

27. An LED recessed lighting fixture in accordance with claim 25 further comprising a driver retained within the housing, the driver accessible through the first access door.

28. An LED recessed lighting fixture in accordance with claim 25 further comprising a an emergency battery retained within the housing, the emergency battery accessible through the second access door.

29. The LED recessed lighting fixture in accordance with claim 25 further comprising: the diffuser being made of material selected from the group consisting of frosted acrylic and perforated metal.

30. The LED recessed lighting fixture in accordance with claim 25 further comprising: the multiplicity of LEDs on the at least one horizontally aligned LED board are offset from the multiplicity of LEDs on the at least one angled LED board.

31. An LED recessed lighting fixture comprising:

a. a housing having a first lengthwise sidewall, a second oppositely disposed lengthwise sidewall, a first transverse wall, a second transverse wall, a top wall, and a first opening in the top wall adjoining an opening in the first transverse wall with a first access door hingeably affixed to the top wall and covering the adjoining openings, a second opening in the top wall adjoining and opening in the second transverse wall with a second access door hingeably affixed to the top wall and covering the adjoined openings;

b. a heat sink within the interior of the housing, a multiplicity of LED boards each affixed to the heat sink on one surface of each respective LED board, each of the multiplicity of LED boards having a multiplicity of LEDs on a surface which is not affixed to the heat sink; and c. a diffuser retained within the fixture and extending over all of the LED boards so that illumination from the LEDs shine through the diffuser.

32. An LED recessed lighting fixture in accordance with claim 31 further comprising: at least one reflector retained within the housing so that some illumination from some of the LEDs is reflected off the at least one reflector.

33. An LED recessed lighting fixture in accordance with claim 31 further comprising: at least one LED board is horizontally aligned and parallel to the top wall.

34. An LED recessed lighting fixture in accordance with claim 31 further comprising: at least one LED board is aligned at an angle to the top wall.

35. An LED recessed lighting fixture in accordance with claim 31 further comprising: the diffuser is made of material selected form the group consisting of frosted acrylic and perforated metal.

36. An LED recessed lighting fixture in accordance with claim 31 further comprising a driver retained within the housing, the driver accessible through the first access door.

37. An LED recessed lighting fixture in accordance with claim 31 further comprising a an emergency battery retained within the housing, the emergency battery accessible through the second access door.

38. The LED recessed lighting fixture in accordance with claim 31 where during a power failure in which power to the fixture is interrupted, the emergency battery will enable a selected few of the LEDs on one of the LED boards to provide illumination for a given period of time.

39. The LED recessed lighting fixture in accordance with claim 31 further comprising dimming means by which the illumination from at least some of the LEDs is dimmed.

40. The LED recessed lighting fixture in accordance with claim 31 further comprising means to cause only LEDs from selected LED boards to illuminate while LEDs on some LED boards do not illuminate.

41. The LED recessed lighting fixture in accordance with claim 31 further comprising: LEDs from at least one of the multiplicity of LED boards are offset from LEDs on at least another of the multiplicity of LED boards.

42. The LED recessed lighting fixture in accordance with claim 31 further comprising the diffuser having a wavy interior surface.

43. The LED recessed lighting fixture in accordance with claim 31 further comprising gripping means on the fixture to secure the fixture to a structure and to prevent the fixture from coming loose during an earthquake.

44. The LED recessed lighting fixture in accordance with claim 31 wherein the housing shape is selected form the group consisting of square shaped and rectangular shaped.

45. An LED recessed lighting fixture in accordance with claim 31, further comprising:

a. said housing having a given interior length; and b. said heat sink extends for the entire given length of the housing.

46. An LED recessed lighting fixture in accordance with claim 31, further comprising said heat sink is retained entirely within the interior of said housing.

47. An led recessed lighting fixture in accordance with claim 31, further comprising:

a. said housing having a given width; and b. said heat sink positioned in the middle of the width of the housing.

48. An LED recessed lighting fixture in accordance with claim 31 further comprising said diffuser having an interior which is sealed when in place to prevent dirt and debris from entering the interior of the diffuser.

* * * * *